US012428712B2

(12) United States Patent
Matsuo et al.

(10) Patent No.: US 12,428,712 B2
(45) Date of Patent: Sep. 30, 2025

(54) MARTENSITIC STAINLESS STEEL MATERIAL

(71) Applicant: NIPPON STEEL CORPORATION, Tokyo (JP)

(72) Inventors: Daisuke Matsuo, Tokyo (JP); Yusaku Tomio, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 359 days.

(21) Appl. No.: 18/245,773

(22) PCT Filed: Oct. 7, 2021

(86) PCT No.: PCT/JP2021/037134
§ 371 (c)(1),
(2) Date: Mar. 17, 2023

(87) PCT Pub. No.: WO2022/075405
PCT Pub. Date: Apr. 14, 2022

(65) Prior Publication Data

US 2023/0392241 A1 Dec. 7, 2023

(30) Foreign Application Priority Data

Oct. 8, 2020 (JP) ..... 2020-170660
Oct. 8, 2020 (JP) ..... 2020-170661

(51) Int. Cl.
*C22C 38/44* (2006.01)
*C21D 6/00* (2006.01)
(Continued)

(52) U.S. Cl.
CPC ..... *C22C 38/44* (2013.01); *C21D 6/004* (2013.01); *C21D 6/005* (2013.01); *C21D 6/007* (2013.01);
(Continued)

(58) Field of Classification Search
None
See application file for complete search history.

(56) References Cited

U.S. PATENT DOCUMENTS 7,767,039 B2 * 8/2010 Kondo ..... C22C 38/04 420/61
2005/0224143 A1 10/2005 Takabe et al.
(Continued)

FOREIGN PATENT DOCUMENTS

JP 6680409 B1 4/2020
JP 6743992 B1 8/2020
(Continued)

*Primary Examiner* — Alexandra M Moore
(74) *Attorney, Agent, or Firm* — Greer Burns & Crain Ltd.

(57) ABSTRACT

A martensitic stainless steel material according to the present disclosure contains, in mass %, C: 0.030% or less, Ni: 5.05 to 7.50%, Cr: 10.00 to 14.00%, and Mo: 1.50 to 3.50%, and has a yield strength of 758 MPa or more, and on two line segments LS of 1000 μm extending in a wall thickness direction with arbitrary two points as a center located at positions at a depth of 2 mm from the inner surface, a degree of Cr segregation ΔCr defined by Formula (1) and a degree of Mo segregation ΔMo defined by Formula (2) satisfy Formula (3):

$$\Delta Cr=([Cr^*]_{max}-[Cr^*]_{min})/[Cr^*]_{ave} \quad (1)$$

$$\Delta Mo=([Mo^*]_{max}-[Mo^*]_{min})/[Mo^*]_{ave} \quad (2)$$

$$\Delta Cr+\Delta Mo\leq 0.59 \quad (3).$$

2 Claims, 4 Drawing Sheets

(51) Int. Cl.

| | |
|---|---|
| ***C21D 8/10*** | (2006.01) |
| ***C21D 9/08*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C22C 38/54*** | (2006.01) |

(52) U.S. Cl.

CPC ..... *C21D 6/008* (2013.01); *C21D 8/105* (2013.01); *C21D 9/085* (2013.01); *C22C 38/001* (2013.01); *C22C 38/002* (2013.01); *C22C 38/004* (2013.01); *C22C 38/005* (2013.01); *C22C 38/02* (2013.01); *C22C 38/04* (2013.01); *C22C 38/06* (2013.01); *C22C 38/42* (2013.01); *C22C 38/46* (2013.01); *C22C 38/48* (2013.01); *C22C 38/50* (2013.01); *C22C 38/52* (2013.01); *C22C 38/54* (2013.01); *C21D 2211/008* (2013.01)

(56) References Cited

U.S. PATENT DOCUMENTS

| | | | | |
|---|---|---|---|---|
| 2017/0096722 | A1* | 4/2017 | Fujimura | C22C 38/04 |
| 2020/0270715 | A1 | 8/2020 | Endo et al. | |
| 2021/0198764 | A1 | 7/2021 | Endo et al. | |
| 2022/0074009 | A1 | 3/2022 | Endo et al. | |

FOREIGN PATENT DOCUMENTS

| | | | |
|---|---|---|---|
| WO | 2004057050 | A1 | 7/2004 |
| WO | 2019065116 | A1 | 4/2019 |

* cited by examiner

MARTENSITIC STAINLESS STEEL MATERIAL

TECHNICAL FIELD

The present disclosure relates to a steel material, and more particularly relates to a martensitic stainless steel material that is a seamless steel pipe or a round steel bar.

BACKGROUND ART

In oil wells and gas wells (hereunder, oil wells and gas wells are collectively referred to as "oil wells"), a steel material referred to as a downhole member is used that has been processed into a predetermined shape from a seamless steel pipe or a round steel bar. Oil wells are being made deeper in recent years, and consequently there is a demand to enhance the strength of steel materials to be used for oil wells. Specifically, steel materials for oil wells of 80 ksi grade (yield strength is 80 to less than 95 ksi, that is, 552 to less than 655 MPa) and 95 ksi grade (yield strength is 95 to less than 110 ksi, that is, 655 to less than 758 MPa) are being widely utilized. Furthermore, requests have also recently started to be made for steel materials for oil wells of 110 ksi grade (yield strength is 110 to less than 125 ksi, that is, 758 to less than 862 MPa).

In this connection, most deep wells are in sour environments that contain corrosive hydrogen sulfide. In the present description, the term "sour environment" means an acidified environment containing hydrogen sulfide, or hydrogen sulfide and carbon dioxide. Steel materials to be used in such sour environments are required to have not only the aforementioned high strength, but also to have excellent sulfide stress cracking resistance (hereunder, referred to as "SSC resistance").

Martensitic stainless steel materials containing about 13% by mass of Cr are conventionally being used as steel materials that can be applied to sour environments. A martensitic stainless steel material which has a strength of 110 ksi grade and which is also excellent in SSC resistance is proposed in International Application Publication No. WO2019/065116 (Patent Literature 1).

A martensitic stainless steel seamless pipe for oil wells disclosed in Patent Literature 1 contains, in mass %, C: 0.0010 to 0.0094%, Si: 0.5% or less, Mn: 0.05 to 0.5%, P: 0.030% or less, S: 0.005% or less, Ni: 4.6 to 7.3%, Cr: 10.0 to 14.5%, Mo: 1.0 to 2.7%, Al: 0.1% or less, V: 0.2% or less, N: 0.1% or less, Ti: 0.01 to 0.50%, Cu: 0.01 to 1.0%, and Co: 0.01 to 1.0%, and a value (1) and a value (2) satisfy Formula (3), with the balance being Fe and unavoidable impurities. Here, the value (1)=−109.37C+7.307Mn+6.399Cr+6.329Cu+11.343Ni−13.529Mo+1.276W+2.925Nb+196.775N−2.621Ti−120.307, the value (2)=−1.324C+0.0533Mn+0.0268CR+0.0893Cu+0.00526Ni+0.0222Mo−0.0132W−0.473N−0.5Ti−0.514, and Formula (3) is as follows: −35.0≤value (1)≤45, and −0.40≤value (2)≤0.070.

The martensitic stainless steel seamless pipe for oil wells proposed in Patent Literature 1 attempts to achieve an improvement in SSC resistance and high strength from the viewpoint of the design of the chemical composition. Specifically, it is disclosed in Patent Literature 1 that by setting the contents of each of C, Mn, Cr, Cu, Ni, Mo, W, Nb, N, and Ti in the chemical composition within an appropriate range, a yield strength of 110 ksi grade and excellent SSC resistance are obtained.

CITATION LIST

Patent Literature

Patent Literature 1: International Application Publication No. WO2019/065116

SUMMARY OF INVENTION

Technical Problem

As mentioned above, in the martensitic stainless steel seamless pipe for oil wells proposed in Patent Literature 1, a high yield strength and adequate SSC resistance in a sour environment can be compatibly obtained by adjusting the content of each element in the chemical composition. However, adequate SSC resistance in a sour environment together with high strength may be obtained by another means that is different from the means proposed in Patent Literature 1.

An objective of the present disclosure is to provide a martensitic stainless steel material that has high strength and is excellent in SSC resistance.

Solution to Problem

A martensitic stainless steel material according to the present disclosure is as follows.

A martensitic stainless steel material that is a seamless steel pipe or a round steel bar, having a chemical composition consisting of, in mass %:

C: 0.030% or less,
Si: 1.00% or less,
Mn: 1.00% or less,
P: 0.030% or less,
S: 0.0050% or less,
Ni: 5.05 to 7.50%,
Cr: 10.00 to 14.00%,
Mo: 1.50 to 3.50%,
Al: 0.005 to 0.050%,
V: 0.01 to 0.30%,
N: 0.0030 to 0.0100%,
Ti: 0.020 to 0.150%,
Cu: 0.01 to 1.00%,
Co: 0.50% or less,
B: 0 to 0.0050%,
Ca: 0 to 0.0050%,
Mg: 0 to 0.0050%,
rare earth metal (REM): 0 to 0.0050%,
Nb: 0 to 0.15%, and
W: 0 to 0.20%,
with the balance being Fe and impurities,
wherein:
a yield strength is 758 MPa or more;
in a case where the martensitic stainless steel material is the seamless steel pipe,
when, in a cross section including a rolling direction and a wall thickness direction of the seamless steel pipe, an arbitrary two points at positions at a depth of 2 mm from an inner surface are defined as two center points P1, and two line segments of 1000 μm extending in the wall thickness direction with each center point P1 as a center are defined as two line segments LS, energy dispersive X-ray spectroscopy is performed at measurement positions at a pitch of 1 μm on each line segment LS, and a Cr concentration and a Mo concentration at each measurement position are determined;

in a case where the martensitic stainless steel material is the round steel bar, when, in a cross section including a rolling direction and a radial direction of the round steel bar, an arbitrary two points on a central axis of the round steel bar are defined as two center points P1, and two line segments of 1000 μm extending in the radial direction with each center point P1 as a center are defined as two line segments LS, energy dispersive X-ray spectroscopy is performed at measurement positions at a pitch of 1 μm on each line segment LS, and a Cr concentration and a Mo concentration at each measurement position are determined; and when:

an average value of all of the Cr concentrations determined at all of the measurement positions on the two line segments LS is defined as $[Cr]_{ave}$, a sample standard deviation of all of the Cr concentrations determined at all of the measurement positions on the two line segments LS is defined as $\sigma_{Cr}$, among all of the Cr concentrations determined at all of the measurement positions on the two line segments LS, an average value of the Cr concentrations included within a range of $[Cr]_{ave}\pm3\sigma_{Cr}$ is defined as $[Cr^*]_{ave}$, among all of the Cr concentrations determined at all of the measurement positions on the two line segments LS, a maximum value of the Cr concentrations included within a range of $[Cr]_{ave}\pm3\sigma_{Cr}$ is defined as $[Cr^*]_{max}$, among all of the Cr concentrations determined at all of the measurement positions on the two line segments LS, a minimum value of the Cr concentrations included within a range of $[Cr]_{ave}\pm3\sigma_{Cr}$ is defined as $[Cr^*]_{min}$, an average value of all of the Mo concentrations determined at all of the measurement positions on the two line segments LS is defined as $[Mo]_{ave}$, a sample standard deviation of all of the Mo concentrations determined at all of the measurement positions on the two line segments LS is defined as $\sigma_{Mo}$, among all of the Mo concentrations determined at all of the measurement positions on the two line segments LS, an average value of the Mo concentrations included within a range of $[Mo]_{ave}\pm3\sigma_{Mo}$ is defined as $[Mo^*]_{ave}$, among all of the Mo concentrations determined at all of the measurement positions on the two line segments LS, a maximum value of the Mo concentrations included within a range of $[Mo]_{ave}\pm3\sigma_{Mo}$ is defined as $[Mo^*]_{max}$, and among all of the Mo concentrations determined at all of the measurement positions on the two line segments LS, a minimum value of the Mo concentrations included within a range of $[Mo]_{ave}\pm3\sigma_{Mo}$ is defined as $[Mo^*]_{min}$, a degree of Cr segregation ΔCr defined by Formula (1), and a degree of Mo segregation ΔMo defined by Formula (2) satisfy Formula (3):

$$\Delta Cr=([Cr^*]_{max}-[Cr^*]_{min})/[Cr^*]_{ave} \quad (1)$$

$$\Delta Mo=([Mo^*]_{max}-[Mo^*]_{min})/[Mo^*]_{ave} \quad (2)$$

$$\Delta Cr+\Delta Mo\leq0.59 \quad (3).$$

Advantageous Effects of Invention

The martensitic stainless steel material according to the present disclosure has a high strength that is a yield strength of 110 ksi or more (758 MPa or more), and is excellent in SSC resistance.

DESCRIPTION OF EMBODIMENTS

Figure 1:
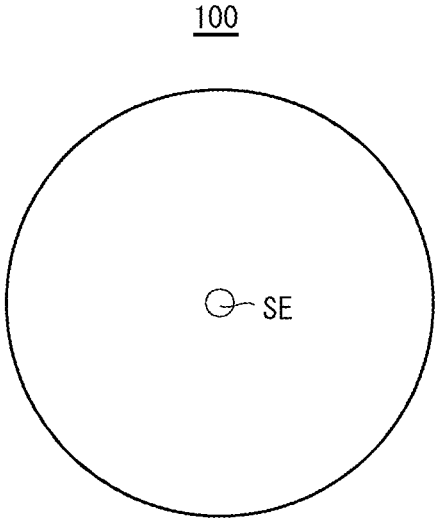
FIG. 1 is a cross-sectional diagram along a direction perpendicular to a longitudinal direction of a starting material of a martensitic stainless steel material of a present embodiment.

The present inventors conducted studies regarding a steel material in which a yield strength of 110 ksi or more (758 MPa or more) and excellent SSC resistance in a sour environment can be compatibly obtained.

First, the present inventors conducted studies regarding a steel material in which a yield strength of 110 ksi or more and excellent SSC resistance can be compatibly obtained, from the viewpoint of the design of the chemical composition. As a result, the present inventors considered that if a steel material consists of, in mass %, C: 0.030% or less, Si: 1.00% or less, Mn: 1.00% or less, P: 0.030% or less, S: 0.0050% or less, Ni: 5.05 to 7.50%, Cr: 10.00 to 14.00%, Mo: 1.50 to 3.50%, Al: 0.005 to 0.050%, V: 0.01 to 0.30%, N: 0.0030 to 0.0100%, Ti: 0.020 to 0.150%, Cu: 0.01 to 1.00%, Co: 0.50% or less, B: 0 to 0.0050%, Ca: 0 to 0.0050%, Mg: 0 to 0.0050%, rare earth metal (REM): 0 to 0.0050%, Nb: 0 to 0.15%, and W: 0 to 0.20%, with the balance being Fe and impurities, there is a possibility that a yield strength of 110 ksi or more and excellent SSC resistance in a sour environment can be compatibly obtained.

Therefore, the present inventors produced a steel material having the aforementioned chemical composition by a well-known method, and evaluated the yield strength and SSC resistance in a sour environment. As a result, the present inventors found that, simply by adjusting the contents of the elements in the chemical composition, a yield strength of 110 ksi or more and excellent SSC resistance in a sour environment are not necessarily adequately obtained compatibly in some cases. Therefore, the present inventors conducted various studies to investigate the reason why, in some cases, a yield strength of 110 ksi or more and excellent SSC resistance in a sour environment cannot be compatibly obtained in a steel material having the aforementioned chemical composition. As a result, the present inventors obtained the following findings.

In the chemical composition described above, the SSC resistance of the steel material in a sour environment is improved by making the content of Cr 10.00 to 14.00%, making the content of Mo 1.50 to 3.50%, and setting the contents of the elements other than Cr and Mo within the aforementioned ranges. The aforementioned content of Cr forms a strong passivation film. By this means the SSC resistance of the steel material in a sour environment increases. In addition, the aforementioned content of Mo forms Mo sulfides on the passivation film, and thereby inhibits contact between the passivation film and hydrogen sulfide ions ($HS^-$). As a result, the SSC resistance of the steel material in a sour environment increases.

However, Cr, and Mo are elements that easily segregate. In the aforementioned chemical composition, the content of Cr is 10.00 to 14.00% which is high, and the content of Mo is 1.50 to 3.50% which is also high. Therefore, there is a possibility that Cr and Mo will segregate. If Cr and Mo segregate, there is a possibility that the SSC resistance in a sour environment will be low.

Thus the present inventors investigated the relation between the degrees of segregation of Cr and Mo and the SSC resistance in a sour environment with respect to a martensitic stainless steel material having the aforementioned chemical composition and having a yield strength of 110 ksi or more.

Figure 2:
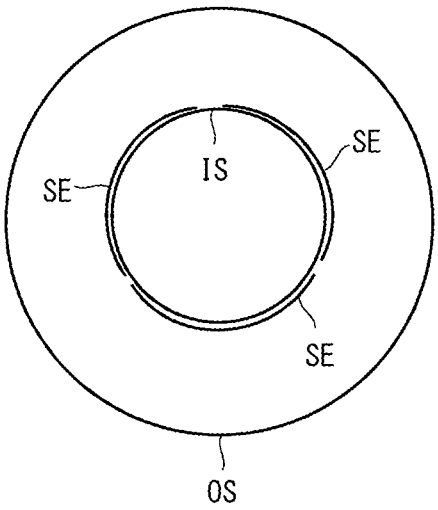
FIG. 2 is a cross-sectional diagram along a direction perpendicular to a rolling direction of a seamless steel pipe.

First, the present inventors conducted studies regarding locations where segregation is likely to occur in the steel material. FIG. 1 is a cross-sectional diagram (transverse cross-sectional diagram) along a direction perpendicular to a longitudinal direction (rolling direction) of a cylindrical billet (round billet) 100 that is the starting material for a seamless steel pipe. Referring to FIG. 1, it has been found that a segregation region SE is likely to be present at the center part in the transverse cross-section of the billet 100. In the segregation region SE, Cr and Mo also easily segregate. Therefore, it was more likely for Cr segregation and Mo segregation to occur in the segregation region SE than in regions other than the segregation region SE. In addition, when the billet 100 illustrated in FIG. 1 was subjected to piercing-rolling to be made into a martensitic stainless steel material that is a seamless steel pipe, a cross section perpendicular to the rolling direction of the seamless steel pipe was as illustrated in FIG. 2. Specifically, in a transverse cross-section of the seamless steel pipe, a segregation region SE extended in a circumferential direction in a vicinity of an inner surface IS of the seamless steel pipe.

Based on the results of the studies described above, the present inventors initially considered that, in a martensitic stainless steel material having the aforementioned chemical composition, a yield strength of 110 ksi or more and excellent SSC resistance in a sour environment can be compatibly obtained if differences between a Cr concentration and a Mo concentration in the segregation region SE that exists in the vicinity of the inner surface IS of a seamless steel pipe and a Cr concentration and a Mo concentration in a region other than the segregation region SE, for example, a vicinity of an outer surface OS in FIG. 2 is made small. That is, the present inventors considered that if segregation within a macroscopic region in the steel material can be suppressed, a yield strength of 110 ksi or more and excellent SSC resistance in a sour environment can be compatibly obtained in a martensitic stainless steel material having the aforementioned chemical composition.

However, in a martensitic stainless steel material having the aforementioned chemical composition, even when differences between the Cr concentration and the Mo concentration in the segregation region SE and the Cr concentration and the Mo concentration in regions other than the segregation region SE were kept small, when the yield strength was made 110 ksi or more, in some cases the SSC resistance was still low.

Therefore, rather than attempting to reduce segregation within a macroscopic region consisting of the segregation region SE and the regions other than the segregation region SE, the present inventors focused their attention on microscopic regions within the segregation region SE. The present inventors therefore investigated making the Cr concentration distribution and the Mo concentration distribution within the microscopic regions sufficiently uniform.

If the Cr concentration distribution and the Mo concentration distribution within microscopic regions can be made sufficiently uniform, the Cr concentration distribution and the Mo concentration distribution of the steel material as a whole will also be sufficiently uniform. As a result, there is a possibility that a yield strength of 110 ksi or more and excellent SSC resistance in a sour environment can be compatibly obtained.

Therefore, instead of focusing their attention on segregation in the macroscopic region, the present inventors focused on microscopic regions within the segregation region SE and conducted further studies regarding the relation between the SSC resistance of the steel material having a yield strength of 110 ksi or more and the Cr concentration distribution and the Mo concentration distribution.

Figure 3:
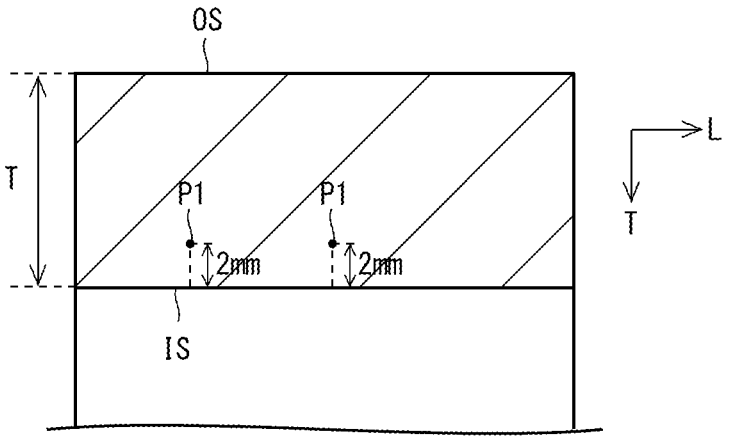
FIG. 3 is a cross-sectional diagram including the rolling direction and a wall thickness direction of the seamless steel pipe.

Specifically, referring to FIG. 3, in a case where the martensitic stainless steel material was a seamless steel pipe, in a cross section including a rolling direction L and a wall thickness direction T of the seamless steel pipe, an arbitrary two points at positions at a depth of 2 mm from the inner surface IS were defined as two center points P1. The two center points P1 were positions which corresponded to the segregation region SE illustrated in FIG. 2.

Figure 4:
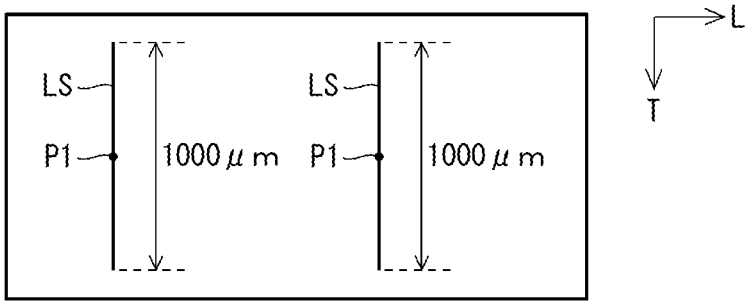
FIG. 4 is an enlarged view of a vicinity of center points P1 in FIG. 3.

FIG. 4 is an enlarged view of a vicinity of the two center points P1 in FIG. 3. Referring to FIG. 4, two line segments of 1000 μm extending in the wall thickness direction T that centered on the respective center points P1 were defined as line segments LS. The two line segments LS corresponded to the interior of the segregation region SE, and were microscopic regions. On each line segment LS, point analysis using energy dispersive X-ray spectroscopy (EDS) was performed at measurement positions at a pitch of 1 μm, and the Cr concentration (mass %) and Mo concentration (mass %) at each measurement position were determined. In the point analysis, the accelerating voltage was set to 20 kV.

The following items were defined based on the determined Cr concentrations.

(A) An average value of all of the Cr concentrations determined at all of the measurement positions on the two line segments LS was defined as $[Cr]_{ave}$.

(B) A sample standard deviation of all of the Cr concentrations determined at all of the measurement positions on the two line segments LS was defined as $\sigma_{Cr}$.

(C) Based on the so-called three sigma rule, among all of the Cr concentrations determined at all of the measurement positions on the two line segments LS, an average value of the Cr concentrations included within a range of $[Cr]_{ave} \pm 3\sigma_{Cr}$ was defined as $[Cr^*]_{ave}$.

(D) Among all of the Cr concentrations determined at all of the measurement positions on the two line segments LS, a maximum value of the Cr concentrations included within a range of $[Cr]_{ave} \pm 3\sigma_{Cr}$ was defined as $[Cr^*]_{max}$.

(E) Among all of the Cr concentrations determined at all of the measurement positions on the two line segments LS, a minimum value of the Cr concentrations included within a range of $[Cr]_{ave} \pm 3\sigma_{Cr}$ was defined as $[Cr^*]_{min}$.

Similarly, the following items were defined based on the determined Mo concentrations.

(F) An average value of all of the Mo concentrations determined at all of the measurement positions on the two line segments LS was defined as $[Mo]_{ave}$.

(G) A sample standard deviation of all of the Mo concentrations determined at all of the measurement positions on the two line segments LS was defined as $\sigma_{Mo}$.

(H) Based on the three sigma rule, among all of the Mo concentrations determined at all of the measurement positions on the two line segments LS, an average value of the Mo concentrations included within a range of $[Mo]_{ave}\pm3\sigma_{Mo}$ was defined as $[Mo^*]_{ave}$.

(I) Among all of the Mo concentrations determined at all of the measurement positions on the two line segments LS, a maximum value of the Mo concentrations included within a range of $[Mo]_{ave}\pm3\sigma_{Mo}$ was defined as $[Mo^*]_{max}$.

(J) Among all of the Mo concentrations determined at all of the measurement positions on the two line segments LS, a minimum value of the Mo concentrations included within a range of $[Mo]_{ave}\pm3\sigma_{Mo}$ was defined as $[Mo^*]_{min}$.

Based on the items determined in the above (A) to (J), a degree of Cr segregation ΔCr defined by Formula (1) was determined. In addition, a degree of Mo segregation ΔMo defined by Formula (2) was determined.

$$\Delta Cr=([Cr^*]_{max}-[Cr^*]_{min})/[Cr^*]_{ave} \quad (1)$$

$$\Delta Mo=([Mo^*]_{max}-[Mo^*]_{min})/[Mo^*]_{ave} \quad (2)$$

The degree of Cr segregation ΔCr defined by Formula (1) means the degree of Cr segregation within microscopic regions in the segregation region SE. Further, the degree of Mo segregation ΔMo defined by Formula (2) means the degree of Mo segregation within microscopic regions in the segregation region SE.

The present inventors considered that if the degree of Cr segregation ΔCr and the degree of Mo segregation ΔMo in these microscopic regions can be reduced, the Cr concentration distribution and the Mo concentration distribution in the steel material as a whole will come close to being sufficiently uniform. Further, the present inventors considered that if the total value of the degree of Cr segregation ΔCr and the degree of Mo segregation ΔMo can be kept sufficiently low, excellent SSC resistance in a sour environment will be obtained even when the steel material has a yield strength of 110 ksi or more.

Based on the technical idea described above, on the premise that the steel material has the aforementioned chemical composition, the present inventors investigated the relation between the SSC resistance and the total value of the degree of Cr segregation ΔCr and the degree of Mo segregation ΔMo in microscopic regions within the segregation region SE in the steel material. As a result, the present inventors discovered that in a martensitic stainless steel material having the aforementioned chemical composition, in a case where the degree of Cr segregation ΔCr defined by Formula (1), and the degree of Mo segregation ΔMo defined by Formula (2) satisfy Formula (3), a yield strength of 110 ksi or more and excellent SSC resistance in a sour environment can be compatibly obtained.

$$\Delta Cr+\Delta Mo\leq0.59 \quad (3)$$

The martensitic stainless steel material according to the present disclosure was completed based on the technical idea described above, and is as follows.

[1]

A martensitic stainless steel material that is a seamless steel pipe or a round steel bar, having a chemical composition consisting of, in mass %:

C: 0.030% or less,
Si: 1.00% or less,
Mn: 1.00% or less,
P: 0.030% or less,
S: 0.0050% or less,
Ni: 5.05 to 7.50%,
Cr: 10.00 to 14.00%,
Mo: 1.50 to 3.50%,
Al: 0.005 to 0.050%,
V: 0.01 to 0.30%,
N: 0.0030 to 0.0100%,
Ti: 0.020 to 0.150%,
Cu: 0.01 to 1.00%,
Co: 0.50% or less,
B: 0 to 0.0050%,
Ca: 0 to 0.0050%,
Mg: 0 to 0.0050%,
rare earth metal (REM): 0 to 0.0050%,
Nb: 0 to 0.15%, and
W: 0 to 0.20%,
with the balance being Fe and impurities,
wherein:

a yield strength is 758 MPa or more;

in a case where the martensitic stainless steel material is the seamless steel pipe, when, in a cross section including a rolling direction and a wall thickness direction of the seamless steel pipe, an arbitrary two points at positions at a depth of 2 mm from an inner surface are defined as two center points P1, and two line segments of 1000 μm extending in the wall thickness direction with each center point P1 as a center are defined as two line segments LS, energy dispersive X-ray spectroscopy is performed at measurement positions at a pitch of 1 μm on each line segment LS, and a Cr concentration and a Mo concentration at each measurement position are determined;

in a case where the martensitic stainless steel material is the round steel bar, when, in a cross section including a rolling direction and a radial direction of the round steel bar, an arbitrary two points on a central axis of the round steel bar are defined as two center points P1, and two line segments of 1000 μm extending in the radial direction with each center point P1 as a center are defined as two line segments LS, energy dispersive X-ray spectroscopy is performed at measurement positions at a pitch of 1 μm on each line segment LS, and a Cr concentration and a Mo concentration at each measurement position are determined; and when:

an average value of all of the Cr concentrations determined at all of the measurement positions on the two line segments LS is defined as $[Cr]_{ave}$, a sample standard deviation of all of the Cr concentrations determined at all of the measurement positions on the two line segments LS is defined as $\sigma_{Cr}$, among all of the Cr concentrations determined at all of the measurement positions on the two line segments LS, an average value of the Cr concentrations included within a range of $[Cr]_{ave}\pm3\sigma_{Cr}$ is defined as $[Cr^*]_{ave}$, among all of the Cr concentrations determined at all of the measurement positions on the two line segments LS, a maximum value of the Cr concentrations included within a range of $[Cr]_{ave}\pm3\sigma_{Cr}$ is defined as $[Cr^*]_{max}$, among all of the Cr concentrations determined at all of the measurement positions on the two line segments LS, a minimum value of the Cr concentrations included within a range of $[Cr]_{ave} \pm 3\sigma_{Cr}$ is defined as $[Cr^*]_{min}$, an average value of all of the Mo concentrations determined at all of the measurement positions on the two line segments LS is defined as $[Mo]_{ave}$, a sample standard deviation of all of the Mo concentrations determined at all of the measurement positions on the two line segments LS is defined as $\sigma_{Mo}$, among all of the Mo concentrations determined at all of the measurement positions on the two line segments LS, an average value of the Mo concentrations included within a range of $[Mo]_{ave} \pm 3\sigma_{Mo}$ is defined as $[Mo^*]_{ave}$, among all of the Mo concentrations determined at all of the measurement positions on the two line segments LS, a maximum value of the Mo concentrations included within a range of $[Mo]_{ave} \pm 3\sigma_{Mo}$ is defined as $[Mo^*]_{max}$, and among all of the Mo concentrations determined at all of the measurement positions on the two line segments LS, a minimum value of the Mo concentrations included within a range of $[Mo]_{ave} \pm 3\sigma_{Mo}$ is defined as $[Mo^*]_{min}$, a degree of Cr segregation ΔCr defined by Formula (1), and a degree of Mo segregation ΔMo defined by Formula (2) satisfy Formula (3):

$$\Delta Cr = ([Cr^*]_{max} - [Cr^*]_{min})/[Cr^*]_{ave} \quad (1)$$

$$\Delta Mo = ([Mo^*]_{max} - [Mo^*]_{min})/[Mo^*]_{ave} \quad (2)$$

$$\Delta Cr + \Delta Mo \leq 0.59 \quad (3).$$

Here, the term "round steel bar" means a steel bar in which a cross section perpendicular to a longitudinal direction is a circular shape.

[2]

The martensitic stainless steel material according to [1], wherein the chemical composition contains one or more elements selected from the group consisting of:

B: 0.0001 to 0.0050%,

Ca: 0.0001 to 0.0050%,

Mg: 0.0001 to 0.0050%, rare earth metal (REM): 0.0001 to 0.0050%,

Nb: 0.01 to 0.15%, and

W: 0.01 to 0.20%.

Hereunder, the martensitic stainless steel material of the present embodiment is described in detail. The symbol "%" in relation to an element means mass % unless otherwise stated.

[Chemical Composition]

The chemical composition of the martensitic stainless steel material of the present embodiment contains the following elements.

C: 0.030% or Less

Carbon (C) is unavoidably contained. That is, the content of C is more than 0%. C increases hardenability of the steel material and thus increases the strength of the steel material. However, if the content of C is more than 0.030%, C will easily combine with Cr to form Cr carbides. In this case, even if the contents of other elements are within the range of the present embodiment, the SSC resistance of the steel material will be likely to decrease.

Accordingly, the content of C is to be 0.030% or less. A preferable lower limit of the content of C is 0.001%, more preferably is 0.003%, and further preferably is 0.005%. A preferable upper limit of the content of C is 0.025%, more preferably is 0.020%, and further preferably is 0.015%.

Si: 1.00% or Less

Silicon (Si) is unavoidably contained. That is, the content of Si is more than 0%. Si deoxidizes steel. However, if the content of Si is more than 1.00%, the hot workability of the steel material will decrease even if the contents of other elements are within the range of the present embodiment.

Accordingly, the content of Si is to be 1.00% or less. A preferable lower limit of the content of Si is 0.05%, more preferably is 0.10%, and further preferably is 0.15%. A preferable upper limit of the content of Si is 0.70%, more preferably is further preferably is 0.45%, and further preferably is 0.40%.

Mn: 1.00% or Less

Manganese (Mn) is unavoidably contained. That is, the content of Mn is more than 0%. Mn increases hardenability of steel material and thus increases the strength of the steel material. However, if the content of Mn is more than 1.00%, even if the contents of other elements are within the range of the present embodiment, Mn will form coarse inclusions and cause toughness of the steel material to decrease.

Accordingly, the content of Mn is to be 1.00% or less. A preferable lower limit of the content of Mn is 0.10%, more preferably is 0.20%, and further preferably is 0.30%. A preferable upper limit of the content of Mn is 0.80%, more preferably is 0.60%, and further preferably is 0.50%.

P: 0.030% or Less

Phosphorus (P) is an impurity that is unavoidably contained. That is, the content of P is more than 0%. If the content of P is more than 0.030%, even if the contents of other elements are within the range of the present embodiment, P will segregate at grain boundaries and cause toughness of the steel material to markedly decrease.

Accordingly, the content of P is to be 0.030% or less. A preferable upper limit of the content of P is 0.025%, and more preferably is 0.020%. The content of P is preferably as low as possible. However, excessively reducing the content of P will significantly increase the production cost. Therefore, when taking industrial production into consideration, a preferable lower limit of the content of P is 0.001%, more preferably is 0.002%, and further preferably is 0.005%.

S: 0.0050% or Less

Sulfur (S) is an impurity that is unavoidably contained. That is, the content of S is more than 0%. If the content of S is more than 0.0050%, S will excessively segregate at grain boundaries, and an excessively large amount of MnS that is an inclusion will form. In such a case, toughness and hot workability of the steel material will markedly decrease even if the contents of other elements are within the range of the present embodiment.

Accordingly, the content of S is to be 0.0050% or less. A preferable upper limit of the content of S is 0.0030%, and more preferably is 0.0020%. The content of S is preferably as low as possible. However, excessively reducing the content of S will significantly increase the production cost. Therefore, when taking industrial production into consideration, a preferable lower limit of the content of S is 0.0001%, more preferably is 0.0002%, and further preferably is 0.0004%.

Ni: 5.05 to 7.50%

Nickel (Ni) forms sulfides on a passivation film in a sour environment. The Ni sulfides inhibit chloride ions ($Cl^-$) and hydrogen sulfide ions ($HS^-$) from coming into contact with the passivation film. Consequently, it is difficult for the passivation film to be destroyed by chloride ions and hydrogen sulfide ions. As a result, Ni increases the SSC resistance of the steel material in a sour environment. Ni is also an austenite-forming element. Therefore, Ni causes the microstructure of the steel material after quenching to become martensitic. If the content of Ni is less than 5.05%, even if the contents of other elements are within the range of the present embodiment, the aforementioned effects will not be sufficiently obtained.

On the other hand, if the content of Ni is more than 7.50%, even if the contents of other elements are within the range of the present embodiment, the diffusion coefficient of hydrogen in the steel material will excessively decrease. In such a case, particularly in a steel material having a yield strength of 125 ksi grade or more (862 MPa or more), the SSC resistance will, on the contrary, decrease.

Accordingly, the content of Ni is to be 5.05 to 7.50%.

In a case where the yield strength is 110 ksi grade (758 MPa to less than 862 MPa), a preferable range of the content of Ni is 5.05 to less than 6.50%. A more preferable lower limit of the content of Ni in a case where the yield strength is 110 ksi grade is 5.10%, further preferably is 5.20%, and further preferably is 5.30%. A more preferable upper limit of the content of Ni in a case where the yield strength is 110 ksi grade is 6.40%, further preferably is 6.30%, further preferably is 6.20%, and further preferably is 6.10%.

In a case where the yield strength is 125 ksi or more (862 MPa or more), a preferable range of the content of Ni is 6.50 to 7.50%. A more preferable lower limit of the content of Ni in a case where the yield strength is 125 ksi or more is 6.60%, further preferably is 6.70%, and further preferably is 6.75%. A more preferable upper limit of the content of Ni in a case where the yield strength is 125 ksi or more is 7.45%, further preferably is 7.40%, further preferably is 7.35%, and further preferably is 7.30%.

Cr: 10.00 to 14.00%

Chromium (Cr) forms a passivation film on the surface of the steel material in a sour environment, and thereby improves the SSC resistance of the steel material. If the content of Cr is less than 10.00%, the aforementioned effect will not be sufficiently obtained even if the contents of other elements are within the range of the present embodiment. On the other hand, if the content of Cr is more than 14.00%, Cr carbides, intermetallic compounds containing Cr, and Cr oxides will excessively form. In such a case the SSC resistance of the steel material will decrease even if the contents of other elements are within the range of the present embodiment.

Accordingly, the content of Cr is to be 10.00 to 14.00%. A preferable lower limit of the content of Cr is 10.50%, more preferably is 11.00%, further preferably is 11.40%, and further preferably is 11.70%. A preferable upper limit of the content of Cr is 13.70%, more preferably is 13.50%, further preferably is 13.40%, further preferably is 13.10%, and further preferably is 12.90%.

Mo: 1.50 to 3.50%

Molybdenum (Mo) forms sulfides on a passivation film in a sour environment. The Mo sulfides inhibit chloride ions ($Cl^-$) and hydrogen sulfide ions ($HS^-$) from coming into contact with the passivation film. Consequently, it is difficult for the passivation film to be destroyed by chloride ions and hydrogen sulfide ions. As a result, Mo increases the SSC resistance of the steel material in a sour environment. If the content of Mo is less than 1.50%, this effect will not be sufficiently obtained even if the contents of other elements are within the range of the present embodiment. On the other hand, if the content of Mo is more than 3.50%, it will be difficult for austenite to stabilize. As a result, it will be difficult for a microstructure mainly composed of martensite to be stably obtained.

Accordingly, the content of Mo is to be 1.50 to 3.50%.

In a case where the yield strength is 110 ksi grade (758114 Pa to less than 862 MPa), a preferable range of the content of Mo is 1.50 to less than 2.50%. A more preferable lower limit of the content of Mo in a case where the yield strength is 110 ksi grade is 1.53%, further preferably is 1.60%, further preferably is 1.70%, and further preferably is 1.80%. A more preferable upper limit of the content of Mo in a case where the yield strength is 110 ksi grade is 2.45%, more preferably is 2.40%, further preferably is 2.30%, and further preferably is 2.20%.

In a case where the yield strength is 125 ksi or more (862 MPa or more), a preferable range of the content of Mo is 2.50 to 3.50%. A more preferable lower limit of the content of Mo in a case where the yield strength is 125 ksi or more is 2.55%, further preferably is 2.60%, further preferably is 2.65%, and further preferably is 2.70%. A more preferable upper limit of the content of Mo in a case where the yield strength is 125 ksi or more is 3.40%, further preferably is 3.35%, and further preferably is 3.30%.

Al: 0.005 to 0.050%

Aluminum (Al) deoxidizes steel. If the content of Al is less than 0.005%, the aforementioned effect will not be sufficiently obtained even if the contents of other elements are within the range of the present embodiment. On the other hand, if the content of Al is more than 0.050%, even if the contents of other elements are within the range of the present embodiment, coarse Al oxides will form. In this case, the toughness of the steel material will decrease.

Accordingly, the content of Al is to be 0.005 to 0.050%. A preferable lower limit of the content of Al is 0.007%, more preferably is 0.010%, and further preferably is 0.015%. A preferable upper limit of the content of Al is 0.047%, more preferably is 0.043%, and further preferably is 0.040%. In the present description, the term "content of Al" means the content of sol. Al (acid-soluble Al).

V: 0.01 to 0.30%

Vanadium (V) forms V precipitates such as carbides, nitrides, and carbo-nitrides in the steel material. The V precipitates increase the strength of the steel material. If the content of V is less than 0.01%, the aforementioned effect will not be sufficiently obtained even if the contents of other elements are within the range of the present embodiment. On the other hand, if the content of V is more than 0.30%, V precipitates will excessively form and the strength of the steel material will become excessively high. In such a case, the SSC resistance of the steel material will decrease even if the contents of other elements are within the range of the present embodiment.

Accordingly, the content of V is to be 0.01 to 0.30%. A preferable lower limit of the content of V is 0.02%, more preferably is 0.03%, and further preferably is 0.04%. A preferable upper limit of the content of V is 0.25%, more preferably is 0.20%, further preferably is 0.15%, further preferably is 0.10%, further preferably is 0.08%, and further preferably is 0.06%.

N: 0.0030 to 0.0100%

Nitrogen (N) improves pitting resistance of the steel material and increases the SSC resistance of the steel material. If the content of N is less than 0.0030%, the aforementioned effect will not be sufficiently obtained even if the contents of other elements are within the range of the present embodiment. On the other hand, if the content of N is more than 0.0100%, coarse TiN will form. In such a case, the SSC resistance of the steel material will decrease even if the contents of other elements are within the range of the present embodiment.

Accordingly, the content of N is to be 0.0030 to 0.0100%. A preferable lower limit of the content of N is 0.0033%, more preferably is 0.0035%, and further preferably is 0.0038%. A preferable upper limit of the content of N is 0.0090%, more preferably is 0.0080%, further preferably is 0.0075%, and further preferably is Ti: 0.020 to 0.150%

Titanium (Ti) combines with C or N to form Ti precipitates that are carbides or nitrides. The Ti precipitates suppress coarsening of grains by the pinning effect. As a result, the strength of the steel material increases. In addition, an excessive increase in strength due to excessive formation of V precipitates is suppressed by formation of the Ti precipitates. As a result, the SSC resistance of the steel material increases. Here, the term "V precipitates" refers to carbides, nitrides, carbo-nitrides and the like. If the content of Ti is less than 0.020%, the aforementioned effects will not be sufficiently obtained even if the contents of other elements are within the range of the present embodiment. On the other hand, if the content of Ti is more than 0.150%, the aforementioned effects will be saturated. Furthermore, if the content of Ti is more than 0.150%, Ti carbides or Ti nitrides will excessively form, and toughness of the steel material will decrease.

Accordingly, the content of Ti is to be 0.020 to 0.150%. A preferable lower limit of the content of Ti is 0.030%, more preferably is 0.040%, and further preferably is 0.050%. A preferable upper limit of the content of Ti is 0.140%, and more preferably is 0.130%.

Cu: 0.01 to 1.00%

Copper (Cu) is an austenite-forming element similarly to Ni, and causes the microstructure after quenching to become martensitic. If the content of Cu is less than 0.01%, the aforementioned effect will not be sufficiently obtained. On the other hand, if the content of Cu is more than 1.00%, the aforementioned effect will be saturated and the production cost will increase.

Accordingly, the content of Cu is to be 0.01 to 1.00%. A preferable lower limit of the content of Cu is 0.10%, more preferably is 0.15%, and further preferably is 0.20%. A preferable upper limit of the content of Cu is 0.90%, more preferably is 0.85%, and further preferably is 0.80%.

Co: 0.50% or Less

Cobalt (Co) is unavoidably contained. That is, the content of Co is more than 0%. In a sour environment, Co forms sulfides on a passivation film. The Co sulfides inhibit chloride ions ($Cl^-$) and hydrogen sulfide ions ($HS^-$) from coming into contact with the passivation film. Consequently, it is difficult for the passivation film to be destroyed by chloride ions and hydrogen sulfide ions. As a result, Co increases the SSC resistance of the steel material. Co also suppresses the formation of retained austenite, and suppresses the occurrence of variations in the strength of the steel material. However, if the content of Co is more than 0.50%, toughness of the steel material will decrease even if the contents of other elements are within the range of the present embodiment.

Accordingly, the content of Co is to be 0.50% or less. A preferable lower limit of the content of Co is 0.01%, more preferably is 0.05%, further preferably is 0.10%, and further preferably is 0.15%. A preferable upper limit of the content of Co is 0.45%, more preferably is 0.40%, further preferably is 0.35%, and further preferably is 0.30%.

The balance of the chemical composition of the martensitic stainless steel material according to the present embodiment is Fe and impurities. Here, the term "impurities" refers to elements which, during industrial production of the martensitic stainless steel material, are mixed in from ore or scrap that is used as the raw material, or from the production environment or the like, and which are not intentionally contained but are allowed within a range that does not adversely influence the advantageous effects of the martensitic stainless steel material of the present embodiment.

[Regarding Optional Elements]

The chemical composition of the martensitic stainless steel material according to the present embodiment may further contain, in lieu of a part of Fe, one or more optional elements selected from the following group.

B: 0 to 0.0050%

Ca: 0 to 0.0050%

Mg: 0 to 0.0050%

Rare earth metal (REM): 0 to 0.0050%

Nb: 0 to 0.15%

W: 0 to 0.20%

Hereunder, these optional elements are described.

[First Group: B, Ca, Mg, and Rare Earth Metal (REM)]

The chemical composition of the martensitic stainless steel material according to the present embodiment may further contain one or more elements selected from the group consisting of B, Ca, Mg, and rare earth metal (REM) in lieu of a part of Fe. These elements are optional elements, and each of these elements increases the hot workability of the steel material.

B: 0 to 0.0050%

Boron (B) is an optional element, and need not be contained. That is, the content of B may be 0%. When contained, B segregates at austenite grain boundaries and strengthens the grain boundaries. As a result, hot workability of the steel material is increased. If even a small amount of B is contained, the aforementioned effect will be obtained to a certain extent. However, if the content of B is more than 0.0050%, Cr carbo-borides will form even if the contents of other elements are within the range of the present embodiment. In such a case, toughness of the steel material will decrease.

Accordingly, the content of B is to be 0 to 0.0050%. A preferable lower limit of the content of B is 0.0001%, and more preferably is 0.0002%. A preferable upper limit of the content of B is 0.0040%, more preferably is 0.0030%, further preferably is 0.0020%, further preferably is 0.0010%, further preferably is 0.0008%, and further preferably is 0.0007%.

Ca: 0 to 0.0050%

Calcium (Ca) is an optional element, and need not be contained. That is, the content of Ca may be 0%. When contained, Ca spheroidizes and/or refines inclusions, and thereby increases hot workability of the steel material. If even a small amount of Ca is contained, this effect will be obtained to a certain extent. However, if the content of Ca is more than 0.0050%, coarse oxides will form. In such a case, toughness of the steel material will decrease even if the contents of other elements are within the range of the present embodiment.

Accordingly, the content of Ca is to be 0 to 0.0050%. A preferable lower limit of the content of Ca is 0.0001%, more preferably is 0.0005%, further preferably is 0.0010%, and further preferably is 0.0015%. A preferable upper limit of the content of Ca is 0.0045%, more preferably is 0.0040%, and further preferably is 0.0035%.

Mg: 0 to 0.0050%

Magnesium (Mg) is an optional element, and need not be contained. That is, the content of Mg may be 0%. When contained, similarly to Ca, Mg spheroidizes and/or refines inclusions, and thereby increases hot workability of the steel material. If even a small amount of Mg is contained, the aforementioned effect will be obtained to a certain extent. However, if the content of Mg is more than 0.0050%, coarse oxides will form. In such a case, toughness of the steel material will decrease even if the contents of other elements are within the range of the present embodiment.

Accordingly, the content of Mg is to be 0 to 0.0050%. A preferable lower limit of the content of Mg is 0.0001%, more preferably is 0.0002%, and further preferably is 0.0003%. A preferable upper limit of the content of Mg is 0.0040%, more preferably is 0.0030%, further preferably is 0.0020%, and further preferably is 0.0010%.

Rare Earth Metal (REM): 0 to 0.0050%

Rare earth metal (REM) is an optional element, and need not be contained. That is, the content of REM may be 0%. When contained, similarly to Ca, REM spheroidizes and/or refines inclusions, and thereby increases hot workability of the steel material. If even a small amount of REM is contained, the aforementioned effect will be obtained to a certain extent. However, if the content of REM is more than 0.0050%, coarse oxides will fount. In such a case, toughness of the steel material will decrease even if the contents of other elements are within the range of the present embodiment.

Accordingly, the content of REM is to be 0 to 0.0050%. A preferable lower limit of the content of REM is 0.0001%, more preferably is 0.0003%, and further preferably is 0.0005%. A preferable upper limit of the content of REM is 0.0040%, more preferably is 0.0030%, further preferably is 0.0020%, and further preferably is 0.0015%.

Note that, in the present description the term "REM" means one or more elements selected from the group consisting of scandium (Sc) which is the element with atomic number 21, yttrium (Y) which is the element with atomic number 39, and the elements from lanthanum (La) with atomic number 57 to lutetium (Lu) with atomic number 71 that are lanthanoids. Further, in the present description the term "content of REM" refers to the total content of these elements.

[Second Group: Nb and W]

The chemical composition of the martensitic stainless steel material according to the present embodiment may further contain one or more elements selected from the group consisting of Nb and W in lieu of a part of Fe. These elements are optional elements, and each of these elements increases the SSC resistance of the steel material.

Nb: 0 to 0.15%

Niobium (Nb) is an optional element, and need not be contained. That is, the content of Nb may be 0%. When contained, Nb forms Nb precipitates that are fine carbides, nitrides, or carbo-nitrides. The Nb precipitates refine the substructure of the steel material by the pinning effect. As a result, the SSC resistance of the steel material increases. If even a small amount of Nb is contained, the aforementioned effect will be obtained to a certain extent. However, if the content of Nb is more than 0.15%, Nb precipitates will excessively form. In such a case, the SSC resistance of the steel material will decrease even if the contents of other elements are within the range of the present embodiment.

Accordingly, the content of Nb is to be 0 to 0.15%. A preferable lower limit of the content of Nb is 0.01%, more preferably is 0.02%, and further preferably is 0.05%. A preferable upper limit of the content of Nb is 0.14%, more preferably is 0.13%, and further preferably is 0.10%.

W: 0 to 0.20%

Tungsten (W) is an optional element, and need not be contained. That is, the content of W may be 0%. When contained, W stabilizes the passivation film in a sour environment. Consequently, it is difficult for the passivation film to be destroyed by chloride ions and hydrogen sulfide ions. As a result, the SSC resistance of the steel material increases. If even a small amount of W is contained, the aforementioned effect will be obtained to a certain extent. However, if the content of W is more than 0.20%, W will combine with C, and coarse W carbides will be formed. In such a case, toughness of the steel material will decrease even if the contents of other elements are within the range of the present embodiment.

Accordingly, the content of W is to be 0 to 0.20%. A preferable lower limit of the content of W is 0.01%, more preferably is 0.03%, and further preferably is 0.05%. A preferable upper limit of the content of W is 0.14%, and more preferably is 0.13%.

[Regarding Cr Concentration Distribution and Mo Concentration Distribution in Steel Material]

In the martensitic stainless steel material of the present embodiment, in addition, a degree of Cr segregation ΔCr defined by Formula (1), and a degree of Mo segregation ΔMo defined by Formula (2) satisfy Formula (3):

$$\Delta Cr=([Cr^*]_{max}-[Cr^*]_{min})/[Cr^*]_{ave} \quad (1)$$

$$\Delta Mo=([Mo^*]_{max}-[Mo^*]_{min})/[Mo^*]_{ave} \quad (2)$$

$$\Delta Cr+\Delta Mo\leq 0.59 \quad (3).$$

Here, the degree of Cr segregation ΔCr defined by Formula (1), and the degree of Mo segregation ΔMo defined by Formula (2) are determined by the following method.

[Method for Measuring Degree of Cr Segregation ΔCr and Degree of Mo Segregation ΔMo]

Referring to FIG. 3, in a case where the martensitic stainless steel material is a seamless steel pipe, in a cross section including a rolling direction L and a wall thickness direction T of the seamless steel pipe, an arbitrary two points at positions at a depth of 2 mm from an inner surface IS are defined as two center points P1. Referring to FIG. 4, two line segments of 1000 μm extending in the wall thickness direction T with each center point P1 as a center are defined as two line segments LS. On each line segment LS, point analysis using energy dispersive X-ray spectroscopy (EDS) is performed at measurement positions at a pitch of 1 μm, and the Cr concentration (mass %) and the Mo concentration (mass %) at each measurement position are determined. In the point analysis, the accelerating voltage is set to 20 kV.

Figure 5:
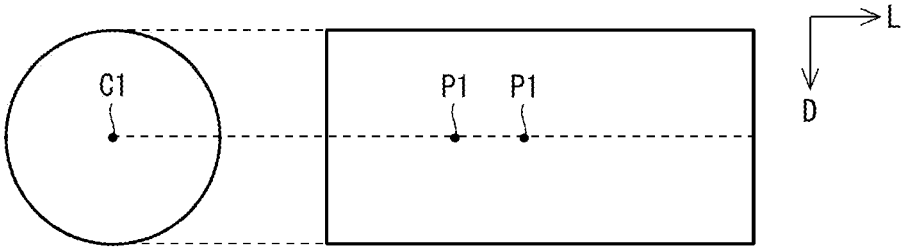
FIG. 5 is a multiple view drawing including a cross-sectional diagram along a direction perpendicular to a rolling direction of a round steel bar, and a cross-sectional diagram along a direction parallel to the rolling direction of the round steel bar.

Similarly, in a case where the martensitic stainless steel material is a round steel bar, referring to FIG. 5, in a cross section including a rolling direction L and a radial direction D of the round steel bar, an arbitrary two points on a central axis C1 of the round steel bar are defined as two center points P1. Two line segments of 1000 μm extending in the radial direction D with each center point P1 as a center are defined as two line segments LS. On each line segment LS, point analysis using EDS is performed at measurement positions at a pitch of 1 μm, and the Cr concentration (mass %) and the Mo concentration (mass %) at each measurement position are determined. In the point analysis, the accelerating voltage is set to 20 kV.

The following items are defined based on the determined Cr concentrations.

(A) An average value of all of the Cr concentrations determined at all of the measurement positions on the two line segments LS is defined as $[Cr]_{ave}$.

(B) A sample standard deviation of all of the Cr concentrations determined at all of the measurement positions on the two line segments LS is defined as $\sigma_{Cr}$.

(C) Based on the so-called three sigma rule, among all of the Cr concentrations determined at all of the measurement positions on the two line segments LS, an average value of the Cr concentrations included within a range of $[Cr]_{ave}\pm3\sigma_{Cr}$ is defined as $[Cr^*]_{ave}$.

(D) Among all of the Cr concentrations determined at all of the measurement positions on the two line segments LS, a maximum value of the Cr concentrations included within a range of $[Cr]_{ave}\pm3\sigma_{Cr}$ is defined as $[Cr^*]_{max}$.

(E) Among all of the Cr concentrations determined at all of the measurement positions on the two line segments LS, a minimum value of the Cr concentrations included within a range of $[Cr]_{ave}\pm3\sigma_{Cr}$ is defined as $[Cr^*]_{min}$.

Similarly, the following items are defined based on the determined Mo concentrations.

(F) An average value of all of the Mo concentrations determined at all of the measurement positions on the two line segments LS is defined as $[Mo]_{ave}$.

(G) A sample standard deviation of all of the Mo concentrations determined at all of the measurement positions on the two line segments LS is defined as $\sigma_{Mo}$.

(H) Based on the three sigma vile, among all of the Mo concentrations determined at all of the measurement positions on the two line segments LS, an average value of the Mo concentrations included within a range of $[Mo]_{ave}\pm3\sigma_{Mo}$ is defined as $[Mo^*]_{ave}$.

(I) Among all of the Mo concentrations determined at all of the measurement positions on the two line segments LS, a maximum value of the Mo concentrations included within a range of $[Mo]_{ave}\pm3\sigma_{Mo}$ is defined as $[Mo^*]_{max}$.

(J) Among all of the Mo concentrations determined at all of the measurement positions on the two line segments LS, a minimum value of the Mo concentrations included within a range of $[Mo]_{ave}\pm3\sigma_{Mo}$ is defined as $[Mo^*]_{min}$.

Based on the items determined in the above (A) to (J), the degree of Cr segregation ΔCr defined by Formula (I) is determined. In addition, the degree of Mo segregation ΔMo defined by Formula (2) is determined.

$$\Delta Cr=([Cr^*]_{max}-[Cr^*]_{min})/[Cr^*]_{ave} \quad (1)$$

$$\Delta Mo=([Mo^*]_{max}-[Mo^*]_{min})/[Mo^*]_{ave} \quad (2)$$

In the martensitic stainless steel material of the present embodiment, the degree of Cr segregation ΔCr defined by Formula (1), and the degree of Mo segregation ΔMo defined by Formula (2) satisfy Formula (3):

$$\Delta Cr+\Delta Mo\leq0.59 \quad (3)$$

Let a total degree of segregation ΔF be defined as ΔF=ΔCr+ΔMo. Each line segment LS that is a measurement region for measuring the Cr concentration and the Mo concentration, in other words, each line segment LS which extends in the wall thickness direction T or the radial direction D and has the center point P1 as its center is a region where Cr and Mo segregate the most in the steel material. The line segments LS are microscopic regions in the steel material. Accordingly, if the total degree of segregation ΔF that is the total sum of the degree of Cr segregation ΔCr and the degree of Mo segregation ΔMo on this line segments LS is 0.59 or less, segregation of the Cr concentration and the Mo concentration is sufficiently suppressed even in the microscopic regions in which the Cr concentration and the Mo concentration are segregated the most. This means that in the entire steel material also, in other words, the macroscopic region of the steel material, the Cr concentration and the Mo concentration are each distributed in a sufficiently uniform manner. By being composed as described above, the martensitic stainless steel material of the present embodiment can obtain excellent SSC resistance in a sour environment while also having a yield strength of 110 ksi or more (758 MPa or more).

A preferable upper limit of ΔF is 0.58, more preferably is 0.57, further preferably is 0.56, further preferably is 0.55, further preferably is 0.54 and further preferably is 0.53.

[Microstructure]

The microstructure of the martensitic stainless steel material according to the present embodiment is mainly composed of martensite. In the present description, the term "martensite" includes not only fresh martensite but also tempered martensite. Moreover, in the present description, the phrase "mainly composed of martensite" means that the volume ratio of martensite is 80.0% or more in the microstructure.

In the microstructure of the martensitic stainless steel material according to the present embodiment, a preferable lower limit of the volume ratio of martensite is 85.0%, and more preferably is 90.0%. Further preferably, the microstructure of the steel material is composed of single-phase martensite.

The balance of the microstructure is retained austenite. That is, the volume ratio of retained austenite is 0 to 20.0% in the martensitic stainless steel material of the present embodiment. The volume ratio of retained austenite is preferably as low as possible.

On the other hand, in the microstructure, a small amount of retained austenite significantly increases the toughness of steel material while suppressing the occurrence of a significant decrease in strength. Accordingly, when it is desired to increase the toughness of the steel material, a microstructure that includes retained austenite may be adopted. However, if the volume ratio of retained austenite is too high, the strength of the steel material will markedly decrease. Accordingly, in a case where the microstructure of the steel material includes retained austenite, a preferable upper limit of the volume ratio of retained austenite is 15.0%, and further preferably is 10.0%.

[Method for Measuring Volume Ratio of Martensite]

The volume ratio (%) of martensite in the microstructure of the martensitic stainless steel material of the present embodiment can be obtained by subtracting the volume ratio (%) of retained austenite, which is obtained by the following method, from 100.0%.

The volume ratio of retained austenite can be obtained by an X-ray diffraction method. Specifically, a test specimen is taken from the martensitic stainless steel material. In a case where the martensitic stainless steel material is a seamless steel pipe, the test specimen is taken from a center portion of the wall thickness of the steel pipe. In a case where the martensitic stainless steel material is a round steel bar, the test specimen is taken from an R/2 portion, that is, a center portion of a radius R in a cross section perpendicular to the longitudinal direction of the round steel bar. Although not particularly limited, the size of the test specimen is, for example, 15 mm×15 mm×a thickness of 2 mm. In this case, the thickness direction of the test specimen is the wall thickness direction in a case where the martensitic stainless steel material is a seamless steel pipe, and is the radial direction in a case where the martensitic stainless steel material is a round steel bar.

Using the obtained test specimen, the X-ray diffraction intensity of each of the (200) plane of α phase, the (211) plane of α phase, the (200) plane of γ phase, the (220) plane of γ phase, and the (311) plane of γ phase is measured to calculate an integrated intensity of each plane. In the measurement of the X-ray diffraction intensity, the target of the X-ray diffraction apparatus is Mo (MoKα ray), and the output is 50 kV and 40 mA.

After calculation, the volume ratio Vγ (%) of retained austenite is calculated using Formula (I) for combinations (2×3=6 pairs) of each plane of the α phase and each plane of the γ phase. Then, an average value of the volume ratios Vγ of retained austenite of the six pairs is defined as the volume ratio (%) of retained austenite.

$$V\gamma=100/\{1+(I\alpha\times R\gamma)/(I\gamma\times R\alpha)\} \quad (I)$$

Where, Iα is an integrated intensity of α phase. Rα is a crystallographic theoretical calculation value of α phase. Iγ is an integrated intensity of γ phase. Rγ is a crystallographic theoretical calculation value of γ phase. Note that, in the present description, Rα in the (200) plane of α phase is 15.9, Rα in the (211) plane of α phase is 29.2, Rγ in the (200) plane of γ phase is 35.5, Rγ in the (220) plane of γ phase is 20.8, and Rγ in the (311) plane of γ phase is 21.8. Note that the volume ratio of retained austenite is obtained by rounding off the second decimal place of an obtained numerical value.

Using the volume ratio (%) of retained austenite obtained by the above described X-ray diffraction method, the volume ratio (vol. %) of martensite of the microstructure of the martensitic stainless steel material is obtained by the following Formula.

Volume ratio of martensite=100.0−volume ratio of retained austenite (%)

[Yield Strength]

The yield strength of the martensitic stainless steel material of the present embodiment is 110 ksi or more, that is, 758 MPa or more.

In the present description, the yield strength means 0.2% offset proof stress (MPa) which is obtained by a tensile test at normal temperature (24±3° C.) in conformity with ASTM E8/E8114 (2013). Specifically, the yield strength is obtained by the following method.

In a case where the martensitic stainless steel material is a seamless steel pipe, a tensile test specimen is taken from the center portion of the wall thickness of the steel pipe. In a case where the martensitic stainless steel material is a round steel bar, a tensile test specimen is taken from the R/2 portion. The tensile test specimen is, for example, a round bar tensile test specimen having a parallel portion diameter of 6.0 mm and a parallel portion length of 40.0 mm. The longitudinal direction of the parallel portion of the round bar tensile test specimen is made parallel with the rolling direction (longitudinal direction) of the martensitic stainless steel material.

A tensile test is conducted at normal temperature (24±3° C.) in conformity with ASTM E8/E8M (2013) using the round bar tensile test specimen to obtain 0.2% offset proof stress (MPa). The obtained 0.2% offset proof stress is defined as the yield strength (MPa).

Although an upper limit of the yield strength of the martensitic stainless steel material of the present embodiment is not particularly limited, when the contents of the elements are within the ranges of the chemical composition described above, the upper limit of the yield strength is, for example, 1000 MPa (145 ksi), and preferably is 965 MPa (140 ksi).

The yield strength of the martensitic stainless steel material of the present embodiment may be 110 ksi grade (758 to less than 862 MPa), or may be 125 ksi or more (862 MPa or more).

In a case where the yield strength of the martensitic stainless steel material of the present embodiment is made 110 ksi grade, a preferable lower limit of the yield strength is 765 MPa, more preferably is 770 MPa, further preferably is 775 MPa, and further preferably is 780 MPa. A preferable upper limit of the yield strength of the martensitic stainless steel material of the present embodiment is 860 MPa, and more preferably is 855 MPa.

In a case where the yield strength of the martensitic stainless steel material of the present embodiment is made 125 ksi or more, a more preferable lower limit of the yield strength is 870 MPa, more preferably is 880 MPa, further preferably is 890 MPa, and further preferably is 900 MPa.

[SSC Resistance of Steel Material]

The SSC resistance of the steel material according to the present embodiment can be evaluated by a SSC resistance evaluation test conducted in accordance with NACE TM0177-2005 Method A.

An SSC resistance evaluation test method that is in accordance with NACE TM0177-2005 Method A is as follows. A round bar specimen is taken from the martensitic stainless steel material according to the present embodiment. If the martensitic stainless steel material is a steel pipe, the round bar specimen is taken from the center portion of the wall thickness. If the martensitic stainless steel material is a round steel bar, the round bar specimen is taken from the R/2 portion. The size of the round bar specimen is not particularly limited. The round bar specimen, for example, has a size in which the diameter of the parallel portion is 6.35 mm, and the length of the parallel portion is 25.4 mm. Note that, the longitudinal direction of the round bar specimen is made parallel with the rolling direction (longitudinal direction) of the martensitic stainless steel material.

An aqueous solution containing 25 mass % of sodium chloride in which the pH is 4.5 is adopted as the test solution. A stress equivalent to 90% of the actual yield stress is applied to the round bar specimen. The test solution at 24° C. is poured into a test vessel so that the round bar specimen to which the stress has been applied is immersed therein, and this is adopted as a test bath. After degassing the test bath, a gaseous mixture consisting of $H_2S$ at 0.05 bar and $CO_2$ at 0.95 bar is blown into the test bath so that the test bath is saturated with $H_2S$ gas. The test bath in which the $H_2S$ gas is saturated is held at 24° C. for 720 hours. After the test specimen has been held for 720 hours, the surface of the test specimen is observed with a magnifying glass with a magnification of ×10 to check for the presence of cracking. If a place is found where cracking is suspected in the observation with a magnifying glass, a cross section at the place where cracking is suspected is observed with an optical microscope with a magnification of ×100 to confirm whether or not there is cracking.

The martensitic stainless steel material of the present embodiment has excellent SSC resistance. Specifically, in the martensitic stainless steel material of the present embodiment, in the aforementioned SSC resistance evaluation test conducted in accordance with NACE TM0177-2005 Method A, cracking is not confirmed after 720 hours elapses. In the present description, the phrase "cracking is not confirmed" means that cracking is not confirmed as a result of observing the test specimen after the test with a magnifying glass with a magnification of ×10 and an optical microscope with a magnification of ×100.

[Shape and Uses of Martensitic Stainless Steel Material]

The martensitic stainless steel material according to the present embodiment is a seamless steel pipe or a round steel bar (solid material). In a case where the martensitic stainless steel material is a seamless steel pipe, the martensitic stainless steel material is a steel pipe for oil country tubular goods. The term "steel pipe for oil country tubular goods" means a steel pipe that is to be used in oil country tubular goods. Oil country tubular goods are, for example, a casing pipe, a tubing pipe, and a drilling pipe which are used for drilling of an oil well or a gas well, collection of crude oil or natural gas, and the like.

In a case where the martensitic stainless steel material is a round steel bar, the martensitic stainless steel material is, for example, to be used for a downhole member.

As described above, in the martensitic stainless steel material of the present embodiment, the content of each element in the chemical composition is within the range of the present embodiment, and in a microscopic segregation region (line segment LS), a degree of Cr segregation ΔCr defined by Formula (1), and a degree of Mo segregation ΔMo defined by Formula (2) satisfy Formula (3). That is, in a microscopic segregation region (line segment LS) in the steel material also, the Cr concentration distribution and the Mo concentration distribution are sufficiently uniform. Therefore, the martensitic stainless steel material of the present embodiment can obtain excellent SSC resistance in a sour environment while also having a yield strength of 110 ksi grade.

[Production Method]

An example of a method for producing the martensitic stainless steel material of the present embodiment will now be described. Note that, the production method described hereunder is an example, and a method for producing the martensitic stainless steel material of the present embodiment is not limited to this production method. That is, as long as the martensitic stainless steel material of the present embodiment that is composed as described above can be produced, a method for producing the martensitic stainless steel material is not limited to the production method described hereunder. However, the production method described hereunder is a favorable method for producing the martensitic stainless steel material of the present embodiment.

One example of a method for producing the martensitic stainless steel material of the present embodiment includes the following processes.

(1) Starting material preparation process (2) Blooming process (3) Steel material production process (4) Heat treatment process Hereunder, each process is described in detail.

[(1) Starting Material Preparation Process]

In the starting material preparation process, molten steel in which the content of each element in the chemical composition is within the range of the present embodiment is produced by a well-known steel-making method. A cast piece is produced by a continuous casting process using the produced molten steel. Here, the cast piece is a bloom or a billet. Instead of the cast piece, an ingot may be produced by an ingot-making process using the aforementioned molten steel. The starting material (bloom or ingot) is produced by the above described production process.

[(2) Blooming Process]

In the blooming process, the starting material (bloom or ingot) is subjected to hot rolling using a blooming mill to thereby produce a billet. The blooming process includes the following processes.

(21) Starting material heating process

(22) Hot working process

Hereunder, each process is described in detail.

[(21) Starting Material Heating Process]

In the starting material heating process, the starting material is heated in a bloom reheating furnace. The in-furnace temperature of the bloom reheating furnace and the holding time of the starting material in the bloom reheating furnace are as follows.

In-furnace temperature of bloom reheating furnace: 1100 to 1300° C.

Holding time in bloom reheating furnace: 200 to 400 minutes

Here, the term "holding time" refers to the in-furnace residence time from a time point at which the in-furnace temperature of the heating furnace reaches a predetermined temperature.

The aforementioned range of the in-furnace temperature (° C.) of the bloom reheating furnace is a well-known range. The aforementioned range of the holding time (minutes) at the bloom reheating furnace is also a well-known range. If the in-furnace temperature of the bloom reheating furnace is 1100 to 1300° C., and the holding time in the bloom reheating furnace is 200 to 400 minutes, the hot workability of the starting material will sufficiently increase. Therefore, in the hot working process in the next process, the starting material can be made into a billet.

Note that, a thermometer (thermocouple) is disposed in the bloom reheating furnace, and it is possible to measure the in-furnace temperature. Further, the holding time (minutes) in the bloom reheating furnace can be determined based on the time point at which the starting material is charged into the bloom reheating furnace and the time point at which the starting material is extracted from the bloom reheating furnace.

[(22) Hot Working Process]

In the hot working process, the starting material that was heated in the starting material heating process is subjected to hot rolling to produce a billet. Specifically, the heated starting material is subjected to hot rolling using a blooming mill to thereby produce a billet. After hot rolling by the blooming mill, as necessary, the starting material may be subjected to further hot rolling using a continuous mill arranged downstream of the blooming mill to produce a billet. The total reduction of area in the blooming process is not particularly limited, and for example is 20 to 70%. The billet produced in the hot working process is cooled to normal temperature before the steel material production process.

[(3) Steel Material Production Process]

In the steel material production process, the billet produced in the blooming process is subjected to hot working to produce a steel material. The steel material production process includes the following processes.

(31) Steel material heating process

(32) Hot working process

Hereunder, each process is described in detail.

[(31) Steel Material Heating Process]

In the steel material heating process, the billet produced in the blooming process is charged into a continuous heating furnace and heated. The heating furnace may be a rotary hearth heating furnace or may be a walking beam heating furnace. In the following description, the use of a rotary hearth heating furnace is described as one example of a continuous heating furnace.

Figure 6:
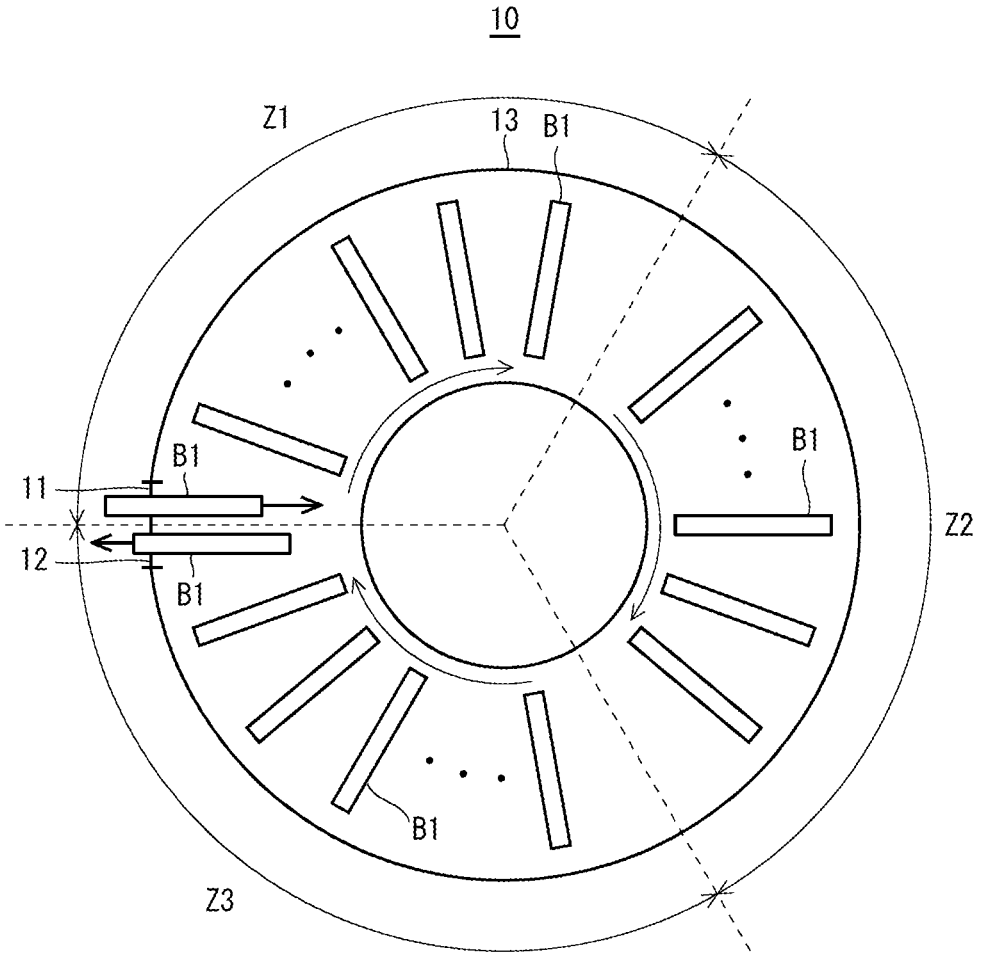
FIG. 6 is a schematic diagram of a heating furnace that is utilized in a process for producing the martensitic stainless steel material of the present embodiment.

FIG. 6 is a schematic diagram (plan view) illustrating a rotary hearth heating furnace that is one example of a continuous heating furnace. Referring to FIG. 6, a heating furnace 10 includes a furnace main body 13 having a charging port 11 and an extraction port 12. A billet B1 which is the object to be heated is charged into the heating furnace 10 from the charging port 11. In FIG. 6, the billet B1 is heated while moving through the inside of the heating furnace. In FIG. 6, the billet B1 that was charged into the heating furnace 10 from the charging port 11 moves in the clockwise direction. When the billet B1 which has been heated while moving arrives at the extraction port 12, the billet B1 is extracted to outside from the extraction port 12.

The furnace main body 13 is divided into a preheating zone Z1, a heating zone Z2, and a holding zone Z3 in that order in the direction from the charging port 11 toward the extraction port 12. The preheating zone Z1 is a zone that has the charging port 11. The preheating zone Z1 is the zone in which the in-furnace temperature is lowest among the three zones (preheating zone Z1, heating zone Z2 and holding zone Z3). The heating zone Z2 is a zone arranged between the preheating zone Z1 and the holding zone Z3. The holding zone Z3 is a zone that follows the heating zone Z2, and has the extraction port 12 at the rear end thereof. The heating zone Z2 and the holding zone Z3 are maintained at approximately the same temperature. Specifically, although the temperature in the holding zone Z3 is somewhat higher than the temperature in the heating zone Z2, the temperature difference between the holding zone Z3 and the heating zone Z2 is 20° C. or less. One or a plurality of burners is provided in each of the zones. In each zone, the temperature is adjusted by means of the burner(s).

In the present embodiment the in-furnace temperature and the residence time in the preheating zone Z1, the heating zone Z2, and the holding zone Z3 are as follows.

[Preheating Zone Z1]

The in-furnace temperature and the residence time in the preheating zone Z1 are as follows.

In-furnace temperature: a temperature from 1000 to 1250° C., and which is a temperature that is lower than an in-furnace temperature Tin the heating zone Z2 and the holding zone Z3

Residence time: 60 minutes or more

In the preheating zone Z1, the in-furnace temperature is 1000 to less than 1250° C., and is set to a lower temperature than an in-furnace temperature T (° C.) in the heating zone Z2 and the holding zone Z3. In addition, the residence time of the billet in the preheating zone Z1 is set to 60 minutes or more. The preheating zone Z1 mainly fulfills a role of increasing the temperature of the billet that is at normal temperature. Preferably, the residence time in the preheating zone Z1 is set to 80 minutes or more, and more preferably is set to 100 minutes or more.

[Heating Zone Z2 and Holding Zone Z3]

The conditions in the heating zone Z2 and the holding zone Z3 are as follows.

In-furnace temperature T: a temperature from 1200 to 1250° C., and which is a temperature that is higher than the in-furnace temperature in the preheating zone Z1

Total residence time t: time that satisfies Formula (A)

These conditions are described hereunder.

(Regarding In-Furnace Temperature T)

With regard to the heating zone Z2 and the holding zone Z3, the in-furnace temperature T in the heating zone Z2 and the holding zone Z3 is set in the range of 1200 to 1250° C., and is set to a temperature that is higher than the in-furnace temperature in the preheating zone Z1. If the in-furnace temperature T in the heating zone Z2 and the holding zone Z3 is less than 1200° C., the Cr concentration distribution and the Mo concentration distribution within the segregation region will not be uniform, and variations will occur. Consequently, in the produced martensitic stainless steel material, the degree of Cr segregation ΔCr and the degree of Mo segregation ΔMo will not satisfy Formula (3). On the other hand, if the in-furnace temperature T in the heating zone Z2 and the holding zone Z3 is more than 1250° C., δ-ferrite will be formed in the steel material having the aforementioned chemical composition. The δ-ferrite will decrease the hot workability of the steel material. Accordingly, the in-furnace temperature T in the heating zone Z2 and the holding zone Z3 is to be within the range of 1200 to 1250° C.

(Regarding Total Residence Time t)

Let the total residence time in the heating zone Z2 and the holding zone Z3 be defined as t (minute). The term "total residence time t" means the time (minutes) from when the billet produced in the blooming process enters the heating zone Z2 until the billet is discharged to outside from the extraction port 12. The in-furnace temperature T and the total residence time tin the heating zone Z2 and the holding zone Z3 are set so as to satisfy the following Formula (A):

$$3050 \leq (t/60)^{0.5} \times (T+273) \quad \text{(A)}$$

Here, in Formula (A), the total residence time t (minutes) of the billet in the heating zone Z2 and the holding zone Z3 is substituted for "t". Further, the in-furnace temperature T (° C.) in the heating zone Z2 and the holding zone Z3 is substituted for "T". Note that, an arithmetic average value of the in-furnace temperature (° C.) in the heating zone Z2 obtained with a thermometer and the in-furnace temperature (° C.) in the holding zone Z3 obtained with a thermometer is adopted as the in-furnace temperature T (° C.) in the heating zone Z2 and the holding zone Z3.

Figure 7:
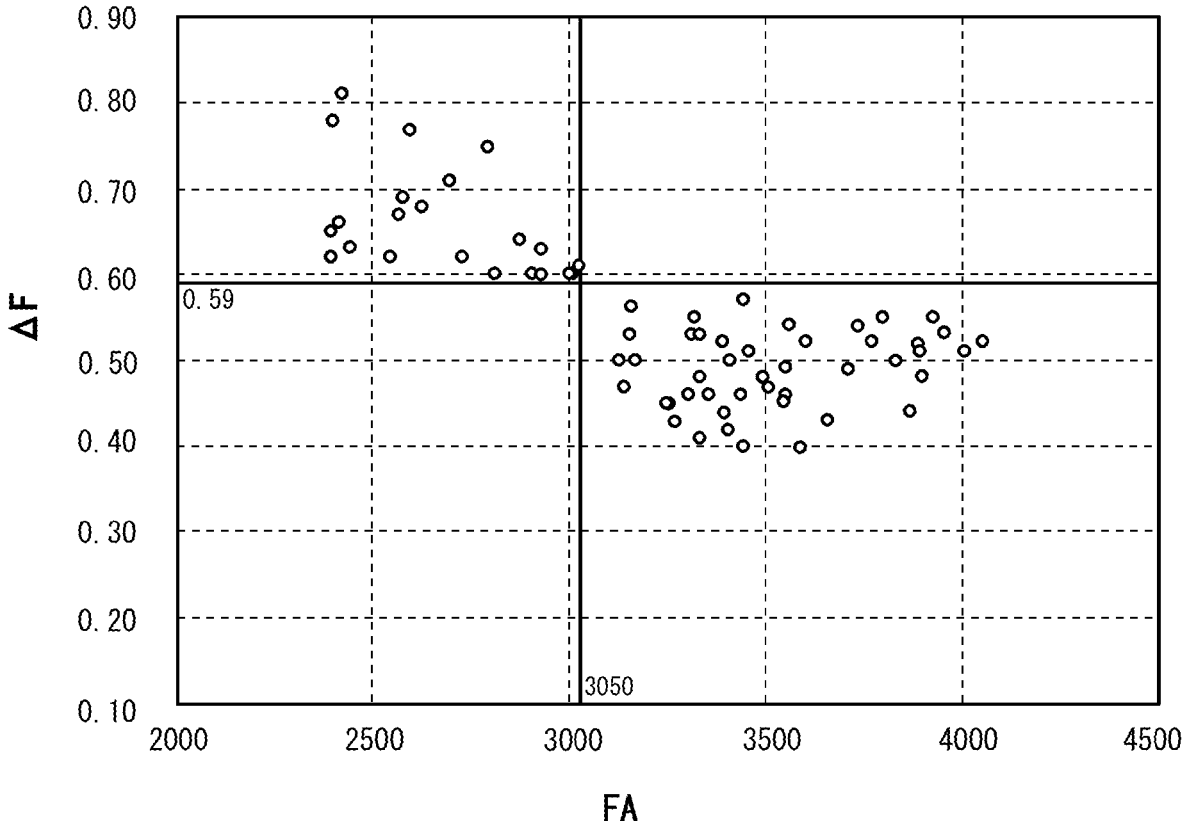
FIG. 7 is a view illustrating a relation between an FA value that is a heating condition and a total degree of segregation ΔF of the martensitic stainless steel material of the present embodiment.

Let FA be defined as $FA=(t/60)^{0.5}\times(T+273)$. FIG. 7 is a view illustrating the relation between FA and a total degree of segregation ΔF (=ΔCr+ΔMo) of Cr and Mo in a microscopic segregation region (line segment LS).

Referring to FIG. 7, if FA is less than 3050, the billet is not sufficiently held in a temperature range of 1200° C. or more. In this case, in the segregation region in the billet, variations in the Cr concentration distribution cannot be sufficiently reduced, and variations in the Mo concentration distribution also cannot be sufficiently reduced. Therefore, as illustrated in FIG. 7, in the produced martensitic stainless steel material, the total degree of segregation ΔF is more than 0.59.

On the other hand, if FA is 3050 or more, the billet is sufficiently held in a temperature range of 1200° C. or more. In this case, in the segregation region in the billet, variations in the Cr concentration distribution are sufficiently reduced, and variations in the Mo concentration distribution are sufficiently reduced. As a result, as illustrated in FIG. 7, in comparison to when FA is less than 3050, the total degree of segregation ΔF in the produced martensitic stainless steel material markedly decreases, and becomes 0.59 or less. That is, variations in the Cr concentration and the Mo concentration in the segregation region can be markedly suppressed.

A preferable lower limit of FA is 3080, more preferably is 3100, further preferably is 3120, further preferably is 3130, and further preferably is 3140. An upper limit of FA is not particularly limited. However, taking into consideration the productivity during normal industrial production, the total residence time t is preferably 500 minutes or less. Accordingly, the upper limit of FA is, for example, 4390.

Note that, a preferable lower limit of the total residence time t (minutes) in the heating zone Z2 and the holding zone Z3 is 230 minutes, more preferably is 240 minutes, further preferably is 250 minutes, and further preferably is 260 minutes.

In the present embodiment, in the steel material heating process, the billet is heated using a continuous heating furnace under conditions so that, in particular, FA satisfies Formula (A) in the temperature range of 1200 to 1250° C. in the heating zone Z2 and the holding zone Z3. Taking into consideration the residence time in the preheating zone Z1, in the present embodiment a preferable furnace time of the billet in the heating furnace is 290 minutes or more, more preferably is 300 minutes or more, and further preferably is 310 minutes or more.

Note that, a thermometer (thermocouple) is arranged in each of the preheating zone Z1, the heating zone Z2, and the holding zone Z3, and thus the in-furnace temperature in the respective zones can be measured. An arithmetic average value of the in-furnace temperature (° C.) in the heating zone Z2 obtained with a thermometer and the in-furnace temperature (° C.) in the holding zone Z3 obtained with a thermometer is defined as the in-furnace temperature T (° C.) in the heating zone Z2 and the holding zone Z3. Further, the residence time of the billet in each zone (preheating zone Z1, heating zone Z2, and holding zone Z3) can be determined based on the order and feeding speed of the billets charged into the heating furnace.

In the above description, a rotary hearth heating furnace has been described as the heating furnace. However, the structure of a walking beam heating furnace is the same as the structure of a rotary hearth heating furnace. Specifically, a walking beam heating furnace includes a main body that has a charging port and an extraction port. The main body is divided into a preheating zone, a heating zone, and a holding zone in that order in the direction from the charging port toward the extraction port. Accordingly, in a walking beam heating furnace also, the conditions of the heating process are as described above.

In FIG. 6, the preheating zone Z1, the heating zone Z2, and the holding zone Z3 are divided equally inside the furnace main body 13. However, the preheating zone Z1, the heating zone Z2, and the holding zone Z3 do not have to be divided equally.

In the production process of the present embodiment, an important point is that heating for a long time period is not performed with respect to as-solidified starting material (bloom or billet), and instead the billet subjected to hot working by the blooming process is subjected to heating for a long time period. The microstructure of as-solidified starting material includes dendrite (a tree-like structure). Dendrite inhibits diffusion of Cr and Mo during heating. By performing hot rolling on the starting material in the blooming process, dendrite is physically or mechanically destroyed. Therefore, in comparison to the microstructure of the starting material in the starting material preparation process, almost no dendritic structure is present in the microstructure of the billet produced in the blooming process, and the microstructure of the billet is a fine microstructure. By subjecting such a billet in which the amount of dendritic structure is small to heating under the aforementioned conditions, Cr and Mo within the billet can be adequately diffused. As a result, in the produced martensitic stainless steel material, the degree of Cr segregation ΔCr defined by Formula (1), and the degree of Mo segregation ΔMo defined by Formula (2) satisfy Formula (3).

[(32) Hot Working Process]

In the hot working process, the billet heated under the aforementioned conditions by the heating process is subjected to hot working. If the end product is a seamless steel pipe, the heated billet is subjected to hot working to produce a hollow shell (seamless steel pipe). For example, hot rolling by the Mannesmann-mandrel process is performed as the hot working to produce a hollow shell. In this case, the billet is subjected to piercing-rolling by a piercing machine. When performing piercing-rolling, although not particularly limited, the piercing ratio is, for example, 1.0 to 4.0. The billet after piercing-rolling is subjected to elongating and rolling using a mandrel mill. In addition, as needed, the billet after elongating and rolling is subjected to diameter adjusting rolling using a reducer or a sizing mill. A hollow shell is produced by the above process. Although not particularly limited, the cumulative reduction of area in the hot working process is, for example, 20 to 70%.

If the end product is a round steel bar, for example, the heated billet is subjected to hot forging to produce a round steel bar.

[(4) Heat Treatment Process]

The heat treatment process includes the following processes.

(41) Quenching process

(42) Tempering process

Each process is described hereunder.

[(41) Quenching Process]

In the heat treatment process, first, the steel material (hollow shell or round steel bar) produced in the hot working process is subjected to quenching (quenching process). The quenching is performed by a well-known method. Specifically, the steel material after the hot working process is charged into a heat treatment furnace and held at a quenching temperature. The quenching temperature is equal to or higher than the $A_{C3}$ transformation point and, for example, is 900 to 1000° C. After being held at the quenching temperature, the steel material is rapidly cooled (quenched). Although not particularly limited, the holding time at the quenching temperature is for example, 10 to 60 minutes. The quenching method is, for example, water cooling or oil cooling. The quenching method is not particularly limited. For example, the hollow shell may be rapidly cooled by immersing the hollow shell in a water bath or an oil bath, or the hollow shell may be rapidly cooled by pouring or jetting cooling water onto the outer surface and/or inner surface of the hollow shell by shower cooling or mist cooling.

In a case where the martensitic stainless steel material is a seamless steel pipe, after the hot working process, quenching (direct quenching) may be performed immediately after the hot working, without cooling the hollow shell to normal temperature. Further, quenching may be performed after the hollow shell after hot working has been held at the quenching temperature after being charged into a supplementary heating furnace before the temperature of the hollow shell decreased after the hot working.

[(42) Tempering Process]

The steel material after quenching is also subjected to a tempering process. In the tempering process, the yield strength of the steel material is adjusted. For the martensitic stainless steel material of the present embodiment, the tempering temperature is set in the range of 500° C. to the $A_{C1}$ transformation point.

In a case where the yield strength of the steel material is to be made 110 ksi grade (758 to less than 862 MPa), a preferable lower limit of the tempering temperature is 510° C., more preferably is 520° C., further preferably is 530° C., and further preferably is 540° C. A preferable upper limit of the tempering temperature is 630° C., more preferably is 620° C., further preferably is 610° C., and further preferably is 600° C. Note that, in a case where the yield strength is to be made 110 ksi grade, in the chemical composition of the steel material, the content of each element is set within the range of the present embodiment, and in addition it is preferable to set the content of Ni within the range of 5.05 to less than 6.50%, and the content of Mo within the range of 1.50 to less than 2.50%.

In a case where the yield strength of the steel material is to be made 125 ksi or more (862 MPa or more), a preferable lower limit of the tempering temperature is 510° C., more preferably is 520° C., further preferably is 530° C., and further preferably is 540° C. A preferable upper limit of the tempering temperature is 600° C., more preferably is 595° C., further preferably is 590° C., and further preferably is 585° C. Note that, in a case where the yield strength is to be made 125 ksi or more, in the chemical composition of the steel material, the content of each element is set within the range of the present embodiment, and in addition it is preferable to set the content of Ni within the range of 6.50 to 7.50%, and the content of Mo within the range of 2.50 to 3.50%.

The holding time at the tempering temperature is not particularly limited, and for example is 10 to 180 minutes. A preferable lower limit of the holding time is 20 minutes. A preferable upper limit of the holding time is 150 minutes, and more preferably is 130 minutes. By appropriately adjusting the tempering temperature according to the chemical composition, the yield strength of the martensitic stainless steel material can be adjusted. Specifically, the tempering conditions are adjusted so that the yield strength of the martensitic stainless steel material becomes 110 ksi or more (758 MPa or more).

The martensitic stainless steel material of the present embodiment can be produced by the processes described above.

Example 1

The advantageous effect of one aspect of the steel material of the present embodiment will be described more specifically by way of examples. The conditions adopted in the following examples are one example of conditions employed for confirming the workability and advantageous effects of the steel material of the present embodiment. Accordingly, the steel material of the present embodiment is not limited to this one example of the conditions.

In Example 1, steel materials having a yield strength of 110 ksi grade (758 to less than 862 MPa) were produced, and various evaluation tests were performed. The details are described hereunder.

[Production of Steel Material]

[Starting Material Preparation Process]

Molten steels having the chemical compositions shown in Table 1 were produced.

TABLE 1

| Test | Chemical Composition (unit is mass %; balance is Fe and impurities) | | | | | | | | | | |
|---|---|---|---|---|---|---|---|---|---|---|---|
| No. | C | Si | Mn | P | S | Ni | Cr | Mo | Al | V | N |
| 1 | 0.009 | 0.24 | 0.34 | 0.015 | 0.0009 | 5.62 | 12.10 | 2.09 | 0.028 | 0.06 | 0.0047 |
| 2 | 0.010 | 0.31 | 0.40 | 0.012 | 0.0006 | 5.41 | 11.90 | 1.96 | 0.033 | 0.05 | 0.0050 |
| 3 | 0.027 | 0.32 | 0.31 | 0.012 | 0.0005 | 5.21 | 12.65 | 2.05 | 0.024 | 0.05 | 0.0048 |
| 4 | 0.012 | 0.25 | 0.43 | 0.013 | 0.0005 | 5.40 | 11.40 | 1.74 | 0.037 | 0.04 | 0.0043 |
| 5 | 0.010 | 0.31 | 0.39 | 0.015 | 0.0007 | 5.65 | 13.30 | 2.18 | 0.032 | 0.06 | 0.0055 |
| 6 | 0.009 | 0.38 | 0.49 | 0.012 | 0.0006 | 5.54 | 12.50 | 2.06 | 0.030 | 0.04 | 0.0061 |
| 7 | 0.009 | 0.37 | 0.46 | 0.016 | 0.0005 | 5.74 | 11.80 | 1.84 | 0.037 | 0.04 | 0.0044 |
| 8 | 0.020 | 0.27 | 0.32 | 0.013 | 0.0008 | 5.20 | 11.42 | 2.25 | 0.037 | 0.05 | 0.0043 |
| 9 | 0.012 | 0.28 | 0.42 | 0.015 | 0.0007 | 5.56 | 11.45 | 1.93 | 0.028 | 0.06 | 0.0040 |
| 10 | 0.024 | 0.26 | 0.30 | 0.015 | 0.0005 | 5.12 | 11.85 | 2.08 | 0.035 | 0.05 | 0.0046 |
| 11 | 0.018 | 0.35 | 0.43 | 0.011 | 0.0008 | 5.43 | 11.19 | 2.08 | 0.025 | 0.03 | 0.0043 |
| 12 | 0.009 | 0.38 | 0.44 | 0.012 | 0.0009 | 5.80 | 12.40 | 1.73 | 0.025 | 0.04 | 0.0058 |
| 13 | 0.011 | 0.23 | 0.40 | 0.013 | 0.0008 | 6.10 | 12.10 | 2.00 | 0.028 | 0.04 | 0.0051 |
| 14 | 0.008 | 0.32 | 0.46 | 0.015 | 0.0008 | 5.61 | 12.20 | 1.71 | 0.027 | 0.07 | 0.0034 |
| 15 | 0.009 | 0.26 | 0.43 | 0.011 | 0.0008 | 6.05 | 11.90 | 2.00 | 0.029 | 0.05 | 0.0050 |
| 16 | 0.008 | 0.37 | 0.37 | 0.014 | 0.0009 | 5.53 | 11.50 | 1.88 | 0.027 | 0.06 | 0.0040 |
| 17 | 0.009 | 0.24 | 0.35 | 0.011 | 0.0005 | 5.51 | 12.00 | 1.92 | 0.027 | 0.05 | 0.0065 |
| 18 | 0.009 | 0.24 | 0.35 | 0.011 | 0.0005 | 5.51 | 12.00 | 1.92 | 0.027 | 0.05 | 0.0065 |
| 19 | 0.012 | 0.38 | 0.48 | 0.016 | 0.0010 | 5.26 | 11.80 | 1.81 | 0.032 | 0.04 | 0.0043 |
| 20 | 0.008 | 0.38 | 0.46 | 0.011 | 0.0010 | 5.44 | 11.20 | 2.17 | 0.037 | 0.04 | 0.0065 |
| 21 | 0.009 | 0.22 | 0.41 | 0.011 | 0.0009 | 6.13 | 13.48 | 1.79 | 0.037 | 0.04 | 0.0065 |
| 22 | 0.012 | 0.29 | 0.34 | 0.016 | 0.0008 | 5.70 | 12.30 | 1.55 | 0.037 | 0.04 | 0.0065 |
| 23 | 0.012 | 0.27 | 0.42 | 0.016 | 0.0007 | 5.49 | 11.50 | 2.46 | 0.037 | 0.04 | 0.0065 |
| 24 | 0.009 | 0.23 | 0.48 | 0.015 | 0.0010 | 5.81 | 9.70 | 1.96 | 0.031 | 0.04 | 0.0039 |
| 25 | 0.012 | 0.35 | 0.33 | 0.011 | 0.0005 | 5.38 | 15.50 | 1.98 | 0.038 | 0.05 | 0.0043 |
| 26 | 0.010 | 0.25 | 0.38 | 0.016 | 0.0007 | 5.87 | 11.10 | 1.41 | 0.028 | 0.07 | 0.0044 |
| 27 | 0.009 | 0.21 | 0.48 | 0.014 | 0.0010 | 5.65 | 12.28 | 2.20 | 0.029 | 0.05 | 0.0065 |
| 28 | 0.010 | 0.26 | 0.43 | 0.014 | 0.0007 | 5.28 | 11.50 | 1.87 | 0.038 | 0.05 | 0.0055 |
| 29 | 0.009 | 0.31 | 0.34 | 0.014 | 0.0007 | 5.29 | 11.70 | 1.83 | 0.032 | 0.06 | 0.0052 |
| 30 | 0.010 | 0.30 | 0.41 | 0.013 | 0.0009 | 6.15 | 12.00 | 2.10 | 0.041 | 0.07 | 0.0033 |
| 31 | 0.009 | 0.24 | 0.35 | 0.011 | 0.0005 | 5.41 | 11.95 | 1.92 | 0.035 | 0.05 | 0.0065 |
| 32 | 0.010 | 0.25 | 0.44 | 0.014 | 0.0006 | 5.28 | 11.39 | 1.93 | 0.037 | 0.05 | 0.0054 |
| 33 | 0.009 | 0.31 | 0.33 | 0.014 | 0.0005 | 5.34 | 11.93 | 1.91 | 0.032 | 0.06 | 0.0051 |
| 34 | 0.010 | 0.38 | 0.41 | 0.015 | 0.0008 | 6.09 | 12.12 | 2.06 | 0.040 | 0.07 | 0.0034 |
| 35 | 0.009 | 0.23 | 0.36 | 0.012 | 0.0007 | 5.52 | 12.07 | 1.94 | 0.036 | 0.05 | 0.0064 |
| 36 | 0.018 | 0.35 | 0.43 | 0.011 | 0.0008 | 5.21 | 11.30 | 2.30 | 0.026 | 0.03 | 0.0042 |
| 37 | 0.010 | 0.24 | 0.36 | 0.012 | 0.0005 | 5.42 | 11.70 | 1.84 | 0.036 | 0.05 | 0.0064 |

TABLE 1-continued

| Test No. | Chemical Composition (unit is mass %; balance is Fe and impurities) | | | | | | | | |
|---|---|---|---|---|---|---|---|---|---|
| | Ti | Cu | Co | B | Ca | Mg | REM | Nb | W |
| 1 | 0.080 | 0.15 | 0.17 | — | — | — | — | — | — |
| 2 | 0.110 | 0.21 | 0.10 | — | — | — | — | — | — |
| 3 | 0.100 | 0.16 | 0.14 | — | — | — | — | — | — |
| 4 | 0.110 | 0.64 | 0.19 | 0.0001 | — | — | — | — | — |
| 5 | 0.100 | 0.22 | 0.19 | — | 0.0024 | — | — | — | — |
| 6 | 0.080 | 0.54 | 0.28 | — | — | 0.0016 | — | — | — |
| 7 | 0.060 | 0.95 | 0.21 | — | — | — | 0.0018 | — | — |
| 8 | 0.150 | 0.08 | 0.15 | — | — | — | — | 0.14 | — |
| 9 | 0.130 | 0.20 | 0.24 | — | — | — | — | — | 0.15 |
| 10 | 0.140 | 0.10 | 0.24 | 0.0004 | — | — | — | — | — |
| 11 | 0.090 | 0.14 | 0.32 | — | — | — | — | — | 0.19 |
| 12 | 0.120 | 0.36 | 0.33 | 0.0004 | 0.0015 | — | — | — | — |
| 13 | 0.130 | 0.69 | 0.18 | 0.0004 | 0.0032 | 0.0009 | — | — | — |
| 14 | 0.080 | 0.24 | 0.32 | 0.0004 | 0.0031 | 0.0006 | 0.0010 | — | — |
| 15 | 0.070 | 0.30 | 0.30 | 0.0005 | 0.0032 | 0.0005 | — | 0.08 | — |
| 16 | 0.110 | 0.79 | 0.30 | 0.0004 | 0.0031 | 0.0010 | — | — | 0.13 |
| 17 | 0.080 | 0.20 | 0.22 | 0.0003 | 0.0023 | 0.0005 | — | 0.01 | 0.01 |
| 18 | 0.080 | 0.20 | 0.22 | 0.0003 | 0.0023 | 0.0005 | — | 0.01 | 0.01 |
| 19 | 0.120 | 0.24 | 0.26 | 0.0001 | 0.0027 | 0.0005 | 0.0010 | 0.08 | 0.12 |
| 20 | 0.120 | 0.23 | 0.16 | — | — | — | — | — | — |
| 21 | 0.120 | 0.01 | 0.26 | — | — | — | — | — | — |
| 22 | 0.070 | 0.39 | 0.31 | — | — | — | — | — | — |
| 23 | 0.090 | 0.06 | 0.26 | — | — | — | — | — | — |
| 24 | 0.110 | 0.32 | 0.33 | — | — | — | — | — | — |
| 25 | 0.130 | 0.16 | 0.29 | — | — | — | — | — | — |
| 26 | 0.060 | 0.76 | 0.33 | — | — | — | — | — | — |
| 27 | 0.120 | 0.19 | 0.12 | — | — | — | — | — | — |
| 28 | 0.070 | 0.80 | 0.23 | — | — | — | — | 0.13 | — |
| 29 | 0.120 | 0.63 | 0.32 | — | — | — | — | — | 0.05 |
| 30 | 0.080 | 0.40 | 0.28 | — | — | — | — | 0.02 | 0.07 |
| 31 | 0.080 | 0.20 | 0.22 | 0.0003 | 0.0023 | 0.0005 | — | 0.01 | 0.01 |
| 32 | 0.070 | 0.79 | 0.23 | — | — | — | — | 0.13 | — |
| 33 | 0.120 | 0.63 | 0.31 | — | — | — | — | — | 0.07 |
| 34 | 0.020 | 0.40 | 0.29 | — | — | — | — | 0.02 | 0.07 |
| 35 | 0.080 | 0.19 | 0.22 | 0.0004 | 0.0023 | 0.0005 | — | 0.02 | 0.01 |
| 36 | 0.088 | 0.14 | 0.12 | — | — | — | — | — | — |
| 37 | 0.080 | 0.23 | 0.21 | 0.0003 | 0.0023 | 0.0005 | — | 0.02 | 0.01 |

In Table 1, the "-" symbol means that the content of the corresponding element was less than the detection limit. Specifically, for example, with regard to Test Number 1 in Table 1, the "-" symbol means that the content of Nb was 0% (0.00%) when rounded off to the second decimal place, and that the content of W was 0% (0.00%) when rounded off to the second decimal place.

Each of the produced molten steels was used to produce a bloom by continuous casting.

[Blooming Process]

Next, in a blooming process, each bloom was subjected to hot rolling to produce a cylindrical billet (round billet) having a diameter of 310 mm. Specifically, first, the bloom was heated in a bloom reheating furnace. The in-furnace temperature (° C.) of the bloom reheating furnace and the holding time (minutes) in the bloom reheating furnace for each test number were as shown in Table 2.

TABLE 2

| Test No. | Blooming Process | | Steel Material Production Process | | | | | |
|---|---|---|---|---|---|---|---|---|
| | In-furnace Temperature in Bloom Reheating Furnace (° C.) | Holding Time in Bloom Reheating Furnace (min) | In-furnace Temperature in Preheating Zone (° C.) | Residence Time in Preheating Zone (min) | In-furnace Temperature T (° C.) in Heating Zone and Holding Zone | Total Residence Time t (min) in Heating Zone and Holding Zone | FA | Furnace Time in Heating Furnace (min) |
| 1 | 1270 | 296 | 1080 | 243 | 1230 | 397 | 3866 | 640 |
| 2 | 1250 | 263 | 1050 | 209 | 1230 | 284 | 3270 | 493 |
| 3 | 1270 | 292 | 1100 | 223 | 1230 | 306 | 3394 | 529 |
| 4 | 1250 | 276 | 1130 | 100 | 1230 | 260 | 3129 | 360 |
| 5 | 1270 | 238 | 1200 | 140 | 1230 | 324 | 3493 | 464 |
| 6 | 1250 | 227 | 1100 | 253 | 1230 | 390 | 3832 | 643 |
| 7 | 1260 | 278 | 1130 | 206 | 1230 | 402 | 3890 | 605 |
| 8 | 1250 | 319 | 1150 | 227 | 1230 | 281 | 3253 | 508 |
| 9 | 1260 | 264 | 1150 | 204 | 1230 | 295 | 3333 | 499 |
| 10 | 1270 | 320 | 1100 | 224 | 1230 | 308 | 3405 | 532 |

TABLE 2-continued

| | | | | | | | | |
|---|---|---|---|---|---|---|---|---|
| 11 | 1260 | 208 | 1060 | 200 | 1230 | 315 | 3444 | 515 |
| 12 | 1260 | 236 | 1100 | 209 | 1230 | 314 | 3438 | 523 |
| 13 | 1260 | 251 | 1030 | 242 | 1230 | 410 | 3929 | 652 |
| 14 | 1260 | 209 | 1100 | 164 | 1230 | 317 | 3455 | 481 |
| 15 | 1250 | 236 | 1200 | 125 | 1230 | 282 | 3258 | 407 |
| 16 | 1260 | 216 | 1150 | 177 | 1230 | 327 | 3509 | 504 |
| 17 | 1270 | 255 | 1170 | 149 | 1200 | 303 | 3310 | 452 |
| 18 | 1270 | 284 | 1070 | 207 | 1250 | 283 | 3308 | 490 |
| 19 | 1250 | 252 | 1080 | 235 | 1230 | 383 | 3797 | 618 |
| 20 | 1270 | 204 | 1070 | 197 | 1230 | 262 | 3141 | 459 |
| 21 | 1270 | 294 | 1110 | 204 | 1230 | 355 | 3656 | 559 |
| 22 | 1260 | 347 | 1070 | 237 | 1230 | 342 | 3588 | 579 |
| 23 | 1270 | 265 | 1130 | 161 | 1230 | 295 | 3333 | 456 |
| 24 | 1270 | 202 | 1090 | 248 | 1230 | 383 | 3797 | 631 |
| 25 | 1270 | 200 | 1120 | 108 | 1230 | 387 | 3817 | 495 |
| 26 | 1250 | 238 | 1050 | 215 | 1230 | 281 | 3253 | 496 |
| 27 | 1260 | 296 | 1170 | 134 | 1230 | 152 | 2392 | 286 |
| 28 | 1250 | 282 | 1130 | 181 | 1230 | 228 | 2930 | 409 |
| 29 | 1250 | 272 | 1100 | 238 | 1230 | 182 | 2618 | 420 |
| 30 | 1250 | 248 | 1160 | 188 | 1230 | 193 | 2696 | 381 |
| 31 | 1250 | 355 | 1200 | 82 | 1230 | 207 | 2792 | 289 |
| 32 | 1250 | 361 | 1100 | 249 | 1210 | 160 | 2422 | 409 |
| 33 | 1260 | 300 | 1100 | 159 | 1210 | 157 | 2399 | 316 |
| 34 | 1270 | 235 | 1090 | 227 | 1210 | 181 | 2576 | 408 |
| 35 | 1270 | 288 | 1090 | 228 | 1210 | 184 | 2597 | 412 |
| 36 | 1250 | 259 | 1170 | 220 | 1210 | 250 | 3027 | 470 |
| 37 | 1260 | 237 | 1120 | 167 | 1200 | 250 | 3007 | 417 |

| | | | | Tempering Process | | | |
|---|---|---|---|---|---|---|---|
| Test No. | ΔCr | ΔMo | ΔF | Temperature (° C.) | Holding Time (min) | Yield Strength (MPa) | SSC Resistance |
| 1 | 0.10 | 0.34 | 0.44 | 595 | 30 | 836 | P |
| 2 | 0.10 | 0.33 | 0.43 | 590 | 30 | 815 | P |
| 3 | 0.12 | 0.32 | 0.44 | 600 | 40 | 795 | P |
| 4 | 0.11 | 0.39 | 0.50 | 595 | 90 | 774 | P |
| 5 | 0.11 | 0.37 | 0.48 | 610 | 35 | 800 | P |
| 6 | 0.12 | 0.38 | 0.50 | 590 | 55 | 811 | P |
| 7 | 0.12 | 0.40 | 0.52 | 565 | 30 | 843 | P |
| 8 | 0.12 | 0.33 | 0.45 | 580 | 45 | 858 | P |
| 9 | 0.12 | 0.29 | 0.41 | 585 | 35 | 843 | P |
| 10 | 0.13 | 0.33 | 0.42 | 575 | 35 | 861 | P |
| 11 | 0.10 | 0.30 | 0.40 | 580 | 35 | 852 | P |
| 12 | 0.10 | 0.36 | 0.46 | 590 | 120 | 784 | P |
| 13 | 0.13 | 0.42 | 0.55 | 565 | 40 | 826 | P |
| 14 | 0.12 | 0.39 | 0.51 | 580 | 45 | 829 | P |
| 15 | 0.10 | 0.35 | 0.45 | 560 | 35 | 844 | P |
| 16 | 0.12 | 0.35 | 0.47 | 610 | 40 | 768 | P |
| 17 | 0.10 | 0.36 | 0.46 | 570 | 40 | 851 | P |
| 18 | 0.13 | 0.40 | 0.53 | 570 | 40 | 855 | P |
| 19 | 0.14 | 0.41 | 0.55 | 600 | 35 | 806 | P |
| 20 | 0.12 | 0.35 | 0.47 | 565 | 30 | 846 | P |
| 21 | 0.10 | 0.33 | 0.43 | 595 | 35 | 814 | P |
| 22 | 0.10 | 0.30 | 0.40 | 595 | 40 | 804 | P |
| 23 | 0.12 | 0.36 | 0.48 | 545 | 45 | 839 | P |
| 24 | 0.07 | 0.42 | 0.49 | 530 | 45 | 834 | F |
| 25 | 0.22 | 0.47 | 0.69 | 610 | 80 | 761 | F |
| 26 | 0.13 | 0.34 | 0.45 | 550 | 45 | 834 | F |
| 27 | 0.14 | 0.51 | 0.65 | 585 | 35 | 840 | F |
| 28 | 0.14 | 0.49 | 0.63 | 620 | 40 | 762 | F |
| 29 | 0.17 | 0.51 | 0.68 | 585 | 55 | 814 | F |
| 30 | 0.16 | 0.55 | 0.71 | 580 | 40 | 845 | F |
| 31 | 0.17 | 0.58 | 0.75 | 590 | 30 | 832 | F |
| 32 | 0.19 | 0.62 | 0.81 | 580 | 120 | 772 | F |
| 33 | 0.18 | 0.60 | 0.78 | 600 | 40 | 817 | F |
| 34 | 0.17 | 0.52 | 0.69 | 585 | 45 | 845 | F |
| 35 | 0.18 | 0.59 | 0.77 | 560 | 35 | 833 | F |
| 36 | 0.19 | 0.38 | 0.61 | 600 | 35 | 822 | F |
| 37 | 0.18 | 0.42 | 0.60 | 575 | 35 | 823 | F |

After the bloom was heated in the bloom reheating furnace, the heated bloom was subjected to hot rolling using a blooming mill to produce a round billet having a diameter of 310 mm.

[Steel Material Production Process]

The round billet of each test number was subjected to a steel material heating process. Specifically, the round billet of each test number was loaded into a rotary hearth heating furnace. The in-furnace temperature (° C.) of the preheating zone, the residence time (minutes) in the preheating zone, the in-furnace temperature T (° C.) in the heating zone and the holding zone, and the total residence time t (minutes) in the heating zone and the holding zone in the heating furnace were as shown in Table 2. Further, $FA=(t/60)^{0.5}\times(T+273)$ was as shown in Table 2. Note that, an arithmetic average value of an in-furnace temperature (° C.) in the heating zone Z2 obtained with a thermometer and an in-furnace temperature (° C.) in the holding zone Z3 obtained with a thermometer was adopted as the in-furnace temperature T (° C.) in the heating zone and the holding zone.

Each of the round billets heated by the steel material heating process was subjected to a hot working process. Specifically, each round billet was subjected to hot rolling by the Mannesmann-mandrel process to thereby produce a hollow shell (seamless steel pipe) of each test number. At such time, the piercing ratio was within the range of 1.0 to 4.0, and the cumulative reduction of area in the hot working process was within the range of 20 to 70%.

[Heat Treatment Process]

Each of the produced hollow shells was subjected to a heat treatment process (quenching process and tempering process). In the quenching process, the quenching temperature was set to 910° C., and the holding time at the quenching temperature was set to 15 minutes. In the tempering process, the tempering temperature (° C.) was set as shown in Table 2, and the holding time (minutes) at the tempering temperature was set as shown in Table 2. The yield strength was adjusted to 110 ksi grade (758 to less than 862 MPa) by the heat treatment process. Martensitic stainless steel materials (seamless steel pipes) were produced by the above production process.

[Evaluation Test]

The seamless steel pipe of each test number was subjected to the following evaluation tests.

(1) Microstructure observation test (2) Cr concentration and Mo concentration measurement test (3) Tensile test (4) SSC resistance evaluation test

[(1) Microstructure Observation Test]

The volume ratio of martensite of the seamless steel pipe of each test number was measured by the following method. Specifically, the volume ratio (%) of retained austenite was determined, and the determined value was subtracted from 100.0% to determine the martensite volume ratio.

The volume ratio of retained austenite was determined by an X-ray diffraction method. Specifically, a test specimen was taken from the center portion of the wall thickness of the seamless steel pipe. The size of the test specimen was 15 mm×15 mm×a thickness of 2 mm. The thickness direction of the test specimen was the wall thickness direction of the seamless steel pipe. Using the obtained test specimen, the X-ray diffraction intensity of each of the (200) plane of α phase, the (211) plane of α phase, the (200) plane of γ phase, the (220) plane of γ phase, and the (311) plane of γ phase was measured, and the integrated intensity of each plane was calculated. In the measurement of the X-ray diffraction intensity, the target of the X-ray diffraction apparatus was Mo (MoKα ray), and the output was set to 50 kV and 40 mA. After calculation, the volume ratio Vγ (%) of retained austenite was calculated using Formula (I) for combinations (2×3=6 pairs) of each plane of the α phase and each plane of the γ phase. Then, an average value of the volume ratios Vγ of retained austenite of the six pairs was defined as the volume ratio (%) of retained austenite.

$$V\gamma=100/\{1+(I\alpha\times R\gamma)/(I\gamma\times R\alpha)\} \quad \text{(I)}$$

Where, Iα is an integrated intensity of α phase. Rα is a crystallographic theoretical calculation value of α phase. Iγ is an integrated intensity of γ phase. Rγ is a crystallographic theoretical calculation value of γ phase. Note that, Rα in the (200) plane of α phase was set to 15.9, Rα in the (211) plane of α phase was set to 29.2, Rγ in the (200) plane of γ phase was set to 35.5, Rγ in the (220) plane of γ phase was set to 20.8, and Rγ in the (311) plane of γ phase was set to 21.8. The volume ratio of retained austenite was obtained by rounding off the second decimal place of the obtained numerical value.

The volume ratio (%) of retained austenite obtained by the X-ray diffraction method described above was used to obtain the volume ratio (%) of martensite in the microstructure of the seamless steel pipe by the following Formula.

Volume ratio of martensite=100.0−volume ratio of retained austenite (%)

The measurement results showed that in each test number the volume ratio of martensite was 80.0% or more.

[(2) Cr Concentration and Mo Concentration Measurement Test]

The degree of Cr segregation ΔCr and the degree of Mo segregation ΔMo of each test number were determined by the following method.

In a cross section including a rolling direction L and a wall thickness direction T of the seamless steel pipe, an arbitrary two points at positions at a depth of 2 mm from the inner surface were defined as two center points P1. Two line segments of 1000 μm extending in the wall thickness direction T with each center point P1 as a center were defined as two line segments LS. On each line segment LS, point analysis using energy dispersive X-ray spectroscopy (EDS) was performed at measurement positions at a pitch of 1 μm, and the Cr concentration (mass %) and the Mo concentration (mass %) at each measurement position were determined. In the point analysis, the accelerating voltage was set to 20 kV.

The following items were defined based on the measured Cr concentration and Mo concentration.

(A) An average value of all of the Cr concentrations determined at all of the measurement positions on the two line segments LS was defined as $[Cr]_{ave}$.

(B) A sample standard deviation of all of the Cr concentrations determined at all of the measurement positions on the two line segments LS was defined as $\sigma_{Cr}$.

(C) Based on the three sigma rule, among all of the Cr concentrations determined at all of the measurement positions on the two line segments LS, an average value of the Cr concentrations included within a range of $[Cr]_{ave}\pm3\sigma_{Cr}$ was defined as $[Cr^*]_{ave}$.

(D) Among all of the Cr concentrations determined at all of the measurement positions on the two line segments LS, a maximum value of the Cr concentrations included within a range of $[Cr]_{ave}\pm3\sigma_{Cr}$ was defined as $[Cr^*]_{max}$.

(E) Among all of the Cr concentrations determined at all of the measurement positions on the two line segments LS, a minimum value of the Cr concentrations included within a range of $[Cr]_{ave}\pm3\sigma_{Cr}$ was defined as $[Cr^*]_{min}$.

(F) An average value of all of the Mo concentrations determined at all of the measurement positions on the two line segments LS was defined as $[Mo]_{ave}$.

(G) A sample standard deviation of all of the Mo concentrations determined at all of the measurement positions on the two line segments LS was defined as $\sigma_{Mo}$.

(H) Based on the three sigma rule, among all of the Mo concentrations determined at all of the measurement positions on the two line segments LS, an average value of the Mo concentrations included within a range of $[Mo]_{ave}\pm3\sigma_{Mo}$ was defined as $[Mo^*]_{ave}$.

(I) Among all of the Mo concentrations determined at all of the measurement positions on the two line segments LS, a maximum value of the Mo concentrations included within a range of $[Mo]_{ave}\pm3\sigma_{Mo}$ was defined as $[Mo^*]_{max}$.

(J) Among all of the Mo concentrations determined at all of the measurement positions on the two line segments LS, a minimum value of the Mo concentrations included within a range of $[Mo]_{ave}\pm3\sigma_{Mo}$ was defined as $[Mo^*]_{min}$.

Based on the items determined in the above (A) to (J), a degree of Cr segregation ΔCr defined by Formula (1) was determined, and a degree of Mo segregation ΔMo defined by Formula (2) was determined.

$$\Delta Cr=([Cr^*]_{max}-[Cr^*]_{min})/[Cr^*]_{ave} \quad (1)$$

$$\Delta Mo=([Mo^*]_{max}-[Mo^*]_{min})/[Mo^*]_{ave} \quad (2)$$

Based on the obtained degree of Cr segregation ΔCr and degree of Mo segregation ΔMo, a total degree of segregation ΔF defined by the following formula was determined.

$$\Delta F=\Delta Cr+\Delta Mo$$

The degree of Cr segregation ΔCr, the degree of Mo segregation ΔMo, and ΔF are shown in Table 2.

[(3) Tensile Test]

The yield strength of the seamless steel pipe of each test number was determined by the following method. A tensile test specimen was taken from the center portion of the wall thickness of the seamless steel pipe. The tensile test specimen was a round bar tensile test specimen in which the diameter of the parallel portion was 6.0 mm, and the length of the parallel portion was 40.0 mm. The longitudinal direction of the parallel portion of the round bar tensile test specimen was parallel to the rolling direction (longitudinal direction) of the seamless steel pipe. A tensile test was conducted at 24° C. in conformity with ASTM E8/E8M (2013) using the round bar tensile test specimen, and the 0.2% offset proof stress (MPa) was determined. The determined 0.2% offset proof stress was defined as the yield strength (MPa). The obtained yield strength is shown in Table 2.

[(4) SSC Resistance Evaluation Test]

The seamless steel pipe of each test number was subjected to an SSC resistance evaluation test in accordance with NACE TM0177-2005 Method A. A round bar specimen was taken from the center portion of the wall thickness of the seamless steel pipe. The round bar specimen had a size in which the diameter of the parallel portion was 6.35 mm, and the length of the parallel portion was 25.4 mm. The longitudinal direction of the parallel portion of the round bar specimen was parallel to the rolling direction (longitudinal direction) of the seamless steel pipe.

An aqueous solution containing 25 mass % of sodium chloride in which the pH was 4.5 was adopted as the test solution. A stress equivalent to 90% of the actual yield stress was applied to the round bar specimen. The test solution at 24° C. was poured into a test vessel so that the round bar specimen to which the stress had been applied was immersed therein, and this was adopted as the test bath. After degassing the test bath, a gaseous mixture consisting of $H_2S$ at 0.05 bar and $CO_2$ at 0.95 bar was blown into the test bath so that the test bath was saturated with $H_2S$ gas. The test bath in which the $H_2S$ gas was saturated was held at 24° C. for 720 hours. After the test specimen had been held for 720 hours, the surface of the test specimen was observed with a magnifying glass with a magnification of ×10 to check for the presence of cracking. If a place where cracking was suspected was found in the observation with the magnifying glass, a cross section at the place where cracking was suspected was observed with an optical microscope with a magnification of ×100 to confirm whether cracking was present.

If the result of confirming whether cracking was present was that cracking was not confirmed even when observed with the magnifying glass with a magnification of ×10 and the optical microscope with a magnification of ×100, the relevant seamless steel pipe was evaluated as being excellent in SSC resistance (described as "P" (Pass) in the column "SSC resistance" in Table 2). On the other hand, if cracking was confirmed when the surface of the test specimen was observed with the magnifying glass with a magnification of ×10 or the optical microscope with a magnification of ×100, the relevant seamless steel pipe was evaluated as having low SSC resistance (described as "F" (Fail) in the column "SSC resistance" in Table 2).

[Evaluation Results]

Referring to Table 2, in Test Numbers 1 to 23, the content of each element in the chemical composition was within the range of the present embodiment. In addition, in the heating process, the in-furnace temperature and residence time in the preheating zone were appropriate, the in-furnace temperature Tin the heating zone and the holding zone was 1200 to 1250° C., and FA was 3050 or more. Therefore, the total degree of segregation ΔF was 0.59 or less, and the Cr concentration distribution and the Mo concentration distribution in a microscopic segregation region in the steel material were sufficiently uniform. As a result, the yield strength was 110 ksi grade (758 to less than 862 MPa), and excellent SSC resistance was obtained.

On the other hand, in Test Number 24, the content of Cr was too low. Therefore, the SSC resistance was low.

In Test Number 25, the content of Cr was too high. Therefore, the total degree of segregation ΔF was more than 0.59. As a result, the SSC resistance was low.

In Test Number 26, the content of Mo was too low. Therefore, the SSC resistance was low.

In Test Numbers 27 to 37, although the content of each element in the chemical composition was within the range of the present embodiment, FA was less than 3050 and Formula (A) was not satisfied. Therefore, the total degree of segregation ΔF in these test numbers was more than 0.59. As a result, in these test numbers the SSC resistance was low.

Example 2

Steel materials (seamless steel pipes) having a yield strength of 125 ksi or more (862 MPa or more) were produced by the same production method as the method used in Example 1. The produced steel materials were subjected to the same evaluation tests as in Example 1.

[Production of Steel Material]

[Starting Material Preparation Process]

Molten steels having the chemical compositions shown in Table 3 were produced.

TABLE 3

| Test | Chemical Composition (unit is mass %; balance is Fe and impurities) | | | | | | | | | | |
|---|---|---|---|---|---|---|---|---|---|---|---|
| No. | C | Si | Mn | Av | S | Ni | Cr | Mo | Al | V | N |
| 1 | 0.011 | 0.34 | 0.35 | 0.018 | 0.0003 | 7.16 | 12.09 | 2.91 | 0.034 | 0.04 | 0.0039 |
| 2 | 0.015 | 0.35 | 0.42 | 0.019 | 0.0005 | 7.28 | 12.15 | 2.82 | 0.029 | 0.03 | 0.0052 |
| 3 | 0.026 | 0.40 | 0.36 | 0.017 | 0.0006 | 6.62 | 12.92 | 3.07 | 0.033 | 0.04 | 0.0069 |
| 4 | 0.008 | 0.34 | 0.22 | 0.020 | 0.0004 | 7.33 | 12.48 | 2.64 | 0.022 | 0.05 | 0.0041 |
| 5 | 0.010 | 0.30 | 0.28 | 0.010 | 0.0006 | 7.01 | 12.67 | 3.16 | 0.024 | 0.04 | 0.0059 |
| 6 | 0.011 | 0.33 | 0.21 | 0.008 | 0.0003 | 6.88 | 11.05 | 3.05 | 0.022 | 0.03 | 0.0059 |
| 7 | 0.011 | 0.35 | 0.34 | 0.017 | 0.0007 | 6.53 | 13.15 | 3.11 | 0.017 | 0.04 | 0.0041 |
| 8 | 0.016 | 0.37 | 0.39 | 0.013 | 0.0003 | 6.76 | 12.30 | 2.95 | 0.034 | 0.03 | 0.0055 |
| 9 | 0.012 | 0.40 | 0.39 | 0.016 | 0.0006 | 6.98 | 11.64 | 3.24 | 0.029 | 0.04 | 0.0054 |
| 10 | 0.028 | 0.39 | 0.36 | 0.015 | 0.0003 | 7.41 | 12.89 | 2.71 | 0.032 | 0.05 | 0.0043 |
| 11 | 0.019 | 0.33 | 0.39 | 0.013 | 0.0005 | 6.89 | 12.83 | 3.23 | 0.032 | 0.05 | 0.0073 |
| 12 | 0.009 | 0.30 | 0.20 | 0.014 | 0.0010 | 6.61 | 11.67 | 2.92 | 0.019 | 0.04 | 0.0036 |
| 13 | 0.009 | 0.29 | 0.37 | 0.019 | 0.0003 | 7.39 | 13.20 | 3.20 | 0.017 | 0.04 | 0.0062 |
| 14 | 0.010 | 0.32 | 0.42 | 0.010 | 0.0009 | 6.69 | 12.54 | 3.25 | 0.017 | 0.04 | 0.0055 |
| 15 | 0.009 | 0.35 | 0.41 | 0.019 | 0.0003 | 6.91 | 12.70 | 3.07 | 0.033 | 0.03 | 0.0057 |
| 16 | 0.009 | 0.35 | 0.42 | 0.017 | 0.0010 | 6.53 | 12.60 | 3.12 | 0.028 | 0.04 | 0.0037 |
| 17 | 0.010 | 0.30 | 0.38 | 0.018 | 0.0010 | 6.78 | 12.23 | 2.73 | 0.034 | 0.03 | 0.0048 |
| 18 | 0.010 | 0.30 | 0.38 | 0.018 | 0.0008 | 6.78 | 12.23 | 2.73 | 0.034 | 0.03 | 0.0048 |
| 19 | 0.009 | 0.30 | 0.31 | 0.008 | 0.0007 | 7.02 | 11.01 | 2.88 | 0.030 | 0.04 | 0.0059 |
| 20 | 0.009 | 0.30 | 0.40 | 0.017 | 0.0006 | 6.85 | 12.71 | 3.10 | 0.030 | 0.05 | 0.0064 |
| 21 | 0.009 | 0.29 | 0.30 | 0.015 | 0.0005 | 7.25 | 11.39 | 3.10 | 0.017 | 0.03 | 0.0055 |
| 22 | 0.012 | 0.30 | 0.42 | 0.011 | 0.0009 | 6.84 | 11.03 | 3.29 | 0.024 | 0.05 | 0.0063 |
| 23 | 0.009 | 0.31 | 0.31 | 0.010 | 0.0003 | 7.11 | 11.89 | 2.82 | 0.019 | 0.03 | 0.0063 |
| 24 | 0.011 | 0.30 | 0.30 | 0.011 | 0.0003 | 6.51 | 9.88 | 3.25 | 0.026 | 0.04 | 0.0040 |
| 25 | 0.011 | 0.28 | 0.37 | 0.010 | 0.0005 | 6.67 | 14.53 | 3.22 | 0.031 | 0.05 | 0.0052 |
| 26 | 0.012 | 0.34 | 0.33 | 0.009 | 0.0009 | 6.89 | 12.09 | 3.87 | 0.030 | 0.05 | 0.0043 |
| 27 | 0.009 | 0.35 | 0.38 | 0.009 | 0.0003 | 6.52 | 12.40 | 2.89 | 0.020 | 0.04 | 0.0054 |
| 28 | 0.010 | 0.32 | 0.35 | 0.018 | 0.0010 | 6.91 | 12.69 | 2.83 | 0.016 | 0.05 | 0.0043 |
| 29 | 0.011 | 0.34 | 0.45 | 0.015 | 0.0003 | 7.04 | 11.59 | 3.26 | 0.034 | 0.04 | 0.0051 |
| 30 | 0.010 | 0.30 | 0.38 | 0.018 | 0.0009 | 6.78 | 12.23 | 2.73 | 0.034 | 0.03 | 0.0048 |
| 31 | 0.008 | 0.45 | 0.39 | 0.009 | 0.0009 | 6.67 | 12.56 | 2.89 | 0.021 | 0.05 | 0.0044 |
| 32 | 0.009 | 0.42 | 0.38 | 0.009 | 0.0010 | 6.56 | 12.38 | 2.89 | 0.024 | 0.04 | 0.0057 |
| 33 | 0.010 | 0.42 | 0.33 | 0.014 | 0.0004 | 6.88 | 12.96 | 2.83 | 0.019 | 0.05 | 0.0045 |
| 34 | 0.009 | 0.33 | 0.42 | 0.015 | 0.0004 | 7.22 | 11.55 | 3.26 | 0.038 | 0.04 | 0.0055 |
| 35 | 0.010 | 0.32 | 0.36 | 0.015 | 0.0004 | 6.78 | 12.49 | 2.73 | 0.035 | 0.05 | 0.0049 |
| 36 | 0.008 | 0.33 | 0.32 | 0.010 | 0.0004 | 7.26 | 12.13 | 2.64 | 0.020 | 0.04 | 0.0038 |
| 37 | 0.001 | 0.39 | 0.40 | 0.012 | 0.0007 | 7.11 | 12.02 | 3.05 | 0.028 | 0.05 | 0.0062 |

| Test | Chemical Composition (unit is mass %; balance is Fe and impurities) | | | | | | | | |
|---|---|---|---|---|---|---|---|---|---|
| No. | Ti | Cu | Co | B | Ca | Mg | REM | Nb | W |
| 1 | 0.090 | 0.46 | 0.23 | — | — | — | — | — | — |
| 2 | 0.110 | 0.26 | 0.24 | — | — | — | — | — | — |
| 3 | 0.110 | 0.26 | 0.21 | — | — | — | — | — | — |
| 4 | 0.100 | 0.22 | 0.14 | 0.0004 | — | — | — | — | — |
| 5 | 0.110 | 0.50 | 0.18 | — | 0.0023 | — | — | — | — |
| 6 | 0.070 | 0.64 | 0.12 | — | — | 0.0008 | — | — | — |
| 7 | 0.060 | 0.28 | 0.23 | — | — | — | 0.0040 | — | — |
| 8 | 0.110 | 0.30 | 0.20 | — | — | — | — | 0.08 | — |
| 9 | 0.110 | 0.26 | 0.23 | — | — | — | — | — | 0.16 |
| 10 | 0.130 | 0.17 | 0.22 | 0.0005 | — | — | — | — | — |
| 11 | 0.140 | 0.22 | 0.17 | — | — | — | — | — | 0.18 |
| 12 | 0.070 | 0.59 | 0.18 | 0.0006 | 0.0018 | — | — | — | — |
| 13 | 0.110 | 0.51 | 0.23 | 0.0004 | 0.0030 | 0.0008 | — | — | — |
| 14 | 0.140 | 0.56 | 0.13 | 0.0005 | 0.0016 | 0.0006 | 0.0010 | — | — |
| 15 | 0.110 | 0.38 | 0.13 | 0.0004 | 0.0019 | 0.0007 | — | 0.03 | — |
| 16 | 0.110 | 0.22 | 0.15 | 0.0003 | 0.0015 | 0.0005 | — | — | 0.06 |
| 17 | 0.070 | 0.73 | 0.22 | 0.0005 | 0.0027 | 0.0009 | — | 0.03 | 0.09 |
| 18 | 0.070 | 0.73 | 0.22 | 0.0005 | 0.0027 | 0.0009 | — | 0.03 | 0.09 |
| 19 | 0.080 | 0.67 | 0.16 | 0.0005 | 0.0031 | 0.0008 | 0.0040 | 0.05 | 0.11 |
| 20 | 0.100 | 0.33 | 0.21 | — | — | — | — | — | — |
| 21 | 0.130 | 0.57 | 0.14 | — | — | — | — | — | — |
| 22 | 0.130 | 0.61 | 0.21 | — | — | — | — | — | — |
| 23 | 0.080 | 0.47 | 0.17 | — | — | — | — | — | — |
| 24 | 0.150 | 0.79 | 0.15 | — | — | — | — | — | — |
| 25 | 0.120 | 0.76 | 0.17 | — | — | — | — | — | — |
| 26 | 0.150 | 0.42 | 0.11 | — | — | — | — | — | — |
| 27 | 0.120 | 0.49 | 0.13 | — | — | — | — | 0.11 | — |
| 28 | 0.130 | 0.56 | 0.19 | — | — | — | — | — | 0.08 |

TABLE 3-continued

| | | | | | | | | | |
|---|---|---|---|---|---|---|---|---|---|
| 29 | 0.140 | 0.35 | 0.14 | — | — | — | — | 0.10 | 0.11 |
| 30 | 0.070 | 0.73 | 0.22 | 0.0005 | 0.0027 | 0.0009 | — | 0.03 | 0.09 |
| 31 | 0.140 | 0.42 | 0.11 | — | — | — | — | 0.11 | — |
| 32 | 0.120 | 0.48 | 0.14 | — | — | — | — | 0.11 | — |
| 33 | 0.120 | 0.57 | 0.17 | — | — | — | — | — | 0.08 |
| 34 | 0.140 | 0.33 | 0.14 | — | — | — | — | 0.10 | 0.11 |
| 35 | 0.070 | 0.65 | 0.20 | 0.0005 | 0.0018 | 0.0007 | — | 0.01 | 0.13 |
| 36 | 0.100 | 0.33 | 0.22 | — | — | — | — | — | — |
| 37 | 0.050 | 0.19 | 0.19 | — | — | — | — | — | — |

The produced molten steels were used to produce blooms by continuous casting. Next, similarly to Example 1, a blooming process was performed to produce round billets having a diameter of 310 mm. The in-furnace temperature (° C.) and holding time (minutes) in the bloom reheating furnace were as shown in Table 4.

TABLE 4

| | Blooming Process | | Steel Material Production Process | | | | |
|---|---|---|---|---|---|---|---|
| Test No. | In-furnace Temperature in Bloom Reheating Furnace (° C.) | Holding Time in Bloom Reheating Furnace (min) | In-furnace Temperature in Preheating Zone (° C.) | Residence Time in Preheating Zone (min) | In-furnace Temperature T (° C.) in Heating Zone and Holding Zone | Total Residence Time t (min) in Heating Zone and Holding Zone | FA |
| 1 | 1250 | 317 | 1000 | 165 | 1230 | 404 | 3900 |
| 2 | 1250 | 343 | 1090 | 168 | 1200 | 329 | 3449 |
| 3 | 1260 | 366 | 1090 | 196 | 1220 | 333 | 3517 |
| 4 | 1270 | 288 | 1000 | 199 | 1230 | 265 | 3159 |
| 5 | 1260 | 291 | 1040 | 131 | 1230 | 336 | 3557 |
| 6 | 1270 | 241 | 1180 | 101 | 1230 | 417 | 3962 |
| 7 | 1270 | 276 | 1190 | 240 | 1230 | 367 | 3717 |
| 8 | 1260 | 292 | 1160 | 188 | 1210 | 301 | 3322 |
| 9 | 1270 | 212 | 3120 | 203 | 1200 | 277 | 3165 |
| 10 | 1250 | 350 | 1080 | 145 | 1230 | 405 | 3905 |
| 11 | 1260 | 214 | 1130 | 162 | 1240 | 333 | 3564 |
| 12 | 1270 | 308 | 1140 | 166 | 1230 | 335 | 3551 |
| 13 | 1270 | 309 | 1050 | 151 | 1230 | 438 | 4061 |
| 14 | 1250 | 281 | 1160 | 113 | 1230 | 336 | 3557 |
| 15 | 1250 | 294 | 1060 | 223 | 1230 | 296 | 3338 |
| 16 | 1260 | 316 | 1090 | 186 | 1230 | 346 | 3609 |
| 17 | 1270 | 237 | 1070 | 238 | 1200 | 312 | 3359 |
| 18 | 1260 | 300 | 1100 | 123 | 1250 | 302 | 3417 |
| 19 | 1260 | 293 | 1040 | 180 | 1250 | 417 | 4015 |
| 20 | 1270 | 303 | 1020 | 214 | 1230 | 267 | 3171 |
| 21 | 1250 | 379 | 1050 | 102 | 1230 | 379 | 3777 |
| 22 | 1270 | 249 | 1030 | 106 | 1230 | 372 | 3742 |
| 23 | 1260 | 280 | 1170 | 106 | 1230 | 306 | 3394 |
| 24 | 1250 | 249 | 1010 | 103 | 1230 | 390 | 3832 |
| 25 | 1250 | 364 | 1030 | 89 | 1230 | 421 | 3981 |
| 26 | 1250 | 341 | 1010 | 161 | 1230 | 386 | 3812 |
| 27 | 1250 | 304 | 1000 | 147 | 1230 | 228 | 2930 |
| 28 | 1250 | 229 | 1030 | 167 | 1230 | 198 | 2730 |
| 29 | 1250 | 305 | 1010 | 216 | 1230 | 210 | 2812 |
| 30 | 1270 | 251 | 1150 | 194 | 1230 | 225 | 2911 |
| 31 | 1250 | 319 | 1060 | 237 | 1230 | 220 | 2878 |
| 32 | 1250 | 299 | 1130 | 176 | 1210 | 163 | 2444 |
| 33 | 1270 | 258 | 1020 | 186 | 1210 | 157 | 2399 |
| 34 | 1260 | 261 | 1180 | 215 | 1210 | 177 | 2547 |
| 35 | 1250 | 361 | 1170 | 156 | 1210 | 180 | 2569 |
| 36 | 1260 | 221 | 1050 | 225 | 1230 | 155 | 2416 |
| 37 | 1260 | 367 | 1060 | 173 | 1200 | 250 | 3007 |

TABLE 4-continued

| Test No. | Steel Material Production Process Furnace Time in Heating Furnace (min) | ΔCr | ΔMo | ΔF | Tempering Process Temperature (° C.) | Holding Time (min) | Yield Strength (MPa) | SSC Resistance |
|---|---|---|---|---|---|---|---|---|
| 1 | 569 | 0.13 | 0.38 | 0.51 | 580 | 30 | 904 | P |
| 2 | 497 | 0.19 | 0.38 | 0.57 | 570 | 30 | 951 | P |
| 3 | 529 | 0.15 | 0.32 | 0.47 | 560 | 35 | 967 | P |
| 4 | 464 | 0.14 | 0.39 | 0.53 | 580 | 35 | 920 | P |
| 5 | 467 | 0.12 | 0.37 | 0.49 | 565 | 30 | 936 | P |
| 6 | 518 | 0.13 | 0.40 | 0.53 | 535 | 35 | 982 | P |
| 7 | 607 | 0.12 | 0.37 | 0.49 | 580 | 35 | 921 | P |
| 8 | 489 | 0.16 | 0.39 | 0.55 | 580 | 40 | 924 | P |
| 9 | 480 | 0.18 | 0.40 | 0.56 | 570 | 35 | 903 | P |
| 10 | 550 | 0.17 | 0.31 | 0.48 | 565 | 50 | 903 | P |
| 11 | 495 | 0.19 | 0.35 | 0.54 | 565 | 40 | 972 | P |
| 12 | 501 | 0.11 | 0.34 | 0.45 | 520 | 55 | 994 | P |
| 13 | 589 | 0.12 | 0.40 | 0.52 | 550 | 60 | 959 | P |
| 14 | 449 | 0.12 | 0.34 | 0.46 | 575 | 30 | 894 | P |
| 15 | 519 | 0.13 | 0.40 | 0.53 | 575 | 30 | 888 | P |
| 16 | 532 | 0.13 | 0.39 | 0.52 | 570 | 30 | 919 | P |
| 17 | 550 | 0.12 | 0.34 | 0.46 | 545 | 35 | 977 | P |
| 18 | 425 | 0.12 | 0.38 | 0.50 | 530 | 40 | 987 | P |
| 19 | 597 | 0.12 | 0.39 | 0.51 | 565 | 40 | 939 | P |
| 20 | 481 | 0.12 | 0.38 | 0.50 | 580 | 35 | 901 | P |
| 21 | 481 | 0.13 | 0.39 | 0.52 | 575 | 35 | 927 | P |
| 22 | 478 | 0.13 | 0.41 | 0.54 | 550 | 55 | 944 | P |
| 23 | 412 | 0.12 | 0.40 | 0.52 | 580 | 45 | 881 | P |
| 24 | 493 | 0.09 | 0.36 | 0.45 | 530 | 40 | 967 | F |
| 25 | 510 | 0.19 | 0.42 | 0.61 | 575 | 50 | 951 | F |
| 26 | 547 | 0.16 | 0.44 | 0.60 | 590 | 45 | 902 | F |
| 27 | 375 | 0.16 | 0.44 | 0.60 | 570 | 40 | 906 | F |
| 28 | 365 | 0.15 | 0.47 | 0.62 | 540 | 40 | 982 | F |
| 29 | 426 | 0.16 | 0.44 | 0.60 | 535 | 40 | 993 | F |
| 30 | 419 | 0.15 | 0.45 | 0.60 | 580 | 35 | 928 | F |
| 31 | 457 | 0.16 | 0.48 | 0.64 | 580 | 35 | 927 | F |
| 32 | 339 | 0.17 | 0.46 | 0.63 | 580 | 35 | 925 | F |
| 33 | 343 | 0.15 | 0.47 | 0.62 | 580 | 35 | 899 | F |
| 34 | 392 | 0.15 | 0.47 | 0.62 | 545 | 35 | 966 | F |
| 35 | 336 | 0.17 | 0.50 | 0.67 | 530 | 35 | 986 | F |
| 36 | 380 | 0.16 | 0.50 | 0.66 | 540 | 30 | 986 | F |
| 37 | 423 | 0.16 | 0.44 | 0.60 | 555 | 35 | 944 | F |

Next, similarly to Example 1, the round billet of each test number was subjected to a steel material production process. In the steel material heating process, the in-furnace temperature (° C.) in the preheating zone, the residence time (minutes) in the preheating zone, the in-furnace temperature T (° C.) in the heating zone and the holding zone, and the total residence time t (minutes) in the heating zone and the holding zone were as shown in Table 4. Further, $FA=(t/60)^{0.5}\times(T+273)$ was as shown in Table 4.

Each heated round billet was subjected to hot working under the same conditions as in Example 1 to thereby produce a hollow shell for each test number. In addition, each produced hollow shell was subjected to a heat treatment process (quenching process and tempering process). In the quenching process, the quenching temperature was set to 910° C., and the holding time at the quenching temperature was set to 15 minutes. In the tempering process, the tempering temperature (° C.) was set as shown in Table 4, and the holding time (minutes) at the tempering temperature was set as shown in Table 4. The yield strength was adjusted to 125 ksi or more (862 MPa or more) by the heat treatment process. Martensitic stainless steel materials (seamless steel pipes) were produced by the above production process.

[Evaluation Tests]

The seamless steel pipe of each test number was subjected to the following evaluation tests by the same methods as the methods employed in Example 1.

(1) Microstructure observation test (2) Cr concentration and Mo concentration measurement test (3) Tensile test (4) SSC resistance evaluation test The result of the microstructure observation test showed that, in each test number, the volume ratio of martensite was 80.0% or more. The results for degree of Cr segregation ΔCr, degree of Mo segregation ΔMo, ΔF, yield strength, and SSC resistance evaluation obtained in the evaluation tests of (2) to (4) mentioned above are shown in Table 4.

[Evaluation Results]

Referring to Table 4, in Test Numbers 1 to 23, the content of each element in the chemical composition was within the range of the present embodiment. In addition, in the heating process, the in-furnace temperature and residence time in the preheating zone were appropriate, the in-furnace temperature Tin the heating zone and the holding zone was 1200 to 1250° C., and FA was 3050 or more. Therefore, the total degree of segregation ΔF was 0.59 or less, and the Cr concentration distribution and the Mo concentration distribution in a microscopic segregation region in the steel material were sufficiently uniform. As a result, the yield strength was 125 ksi grade or more (862 MPa or more), and excellent SSC resistance was obtained.

On the other hand, in Test Number 24 the content of Cr was too low. Therefore, the SSC resistance was low.

In Test Number 25 the content of Cr was too high. Therefore, the total degree of segregation ΔF was more than 0.59. As a result, the SSC resistance was low.

In Test Number 26 the content of Mo was too high. Therefore, the total degree of segregation ΔF was more than 0.59. As a result, the SSC resistance was low.

In Test Numbers 27 to 37, although the content of each element in the chemical composition was within the range of the present embodiment, FA was less than 3050 and Formula (A) was not satisfied. Therefore, the total degree of segregation ΔF in these test numbers was more than 0.59. As a result, in these test numbers the SSC resistance was low.

An embodiment of the present disclosure has been described above. However, the foregoing embodiment is merely an example for implementing the present disclosure. Accordingly, the present disclosure is not limited to the above embodiment, and the above embodiment can be appropriately modified and implemented within a range which does not deviate from the gist of the present disclosure.

REFERENCE SIGNS LIST

10 Heating furnace
100 Billet
SE Segregation region
Z1 Preheating zone
Z2 Heating zone
Z3 Holding zone

The invention claimed is:

1. A martensitic stainless steel material that is a seamless steel pipe or a round steel bar, having a chemical composition consisting of, in mass %:

C: 0.030% or less,
Si: 1.00% or less,
Mn: 1.00% or less,
P: 0.030% or less,
S: 0.0050% or less,
Ni: 5.05 to 7.50%,
Cr: 10.00 to 14.00%,
Mo: 1.50 to 3.50%,
Al: 0.005 to 0.050%,
V: 0.01 to 0.30%,
N: 0.0030 to 0.0100%,
Ti: 0.020 to 0.150%,
Cu: 0.01 to 1.00%,
Co: 0.50% or less,
B: 0 to 0.0050%,
Ca: 0 to 0.0050%,
Mg: 0 to 0.0050%,
rare earth metal (REM): 0 to 0.0050%,
Nb: 0 to 0.15%, and
W: 0 to 0.20%,
with the balance being Fe and impurities,
wherein:

a yield strength is 758 MPa or more;

in a case where the martensitic stainless steel material is the seamless steel pipe, when, in a cross section including a rolling direction and a wall thickness direction of the seamless steel pipe, an arbitrary two points at positions at a depth of 2 mm from an inner surface are defined as two center points P1, and two line segments of 1000 μm extending in the wall thickness direction with each center point P1 as a center are defined as two line segments LS, energy dispersive X-ray spectroscopy is performed at measurement positions at a pitch of 1 μm on each line segment LS, and a Cr concentration and a Mo concentration at each measurement position are determined;

in a case where the martensitic stainless steel material is the round steel bar, when, in a cross section including a rolling direction and a radial direction of the round steel bar, an arbitrary two points on a central axis of the round steel bar are defined as two center points P1, and two line segments of 1000 μm extending in the radial direction with each center point P1 as a center are defined as two line segments LS, energy dispersive X-ray spectroscopy is performed at measurement positions at a pitch of 1 μm on each line segment LS, and a Cr concentration and a Mo concentration at each measurement position are determined; and when:

an average value of all of the Cr concentrations determined at all of the measurement positions on the two line segments LS is defined as $[Cr]_{ave}$, a sample standard deviation of all of the Cr concentrations determined at all of the measurement positions on the two line segments LS is defined as $\sigma_{Cr}$, among all of the Cr concentrations determined at all of the measurement positions on the two line segments LS, an average value of the Cr concentrations included within a range of $[Cr]_{ave}\pm3\sigma_{Cr}$ is defined as $[Cr^*]_{ave}$, among all of the Cr concentrations determined at all of the measurement positions on the two line segments LS, a maximum value of the Cr concentrations included within a range of $[Cr]_{ave}\pm3\sigma_{Cr}$ is defined as $[Cr^*]_{max}$, among all of the Cr concentrations determined at all of the measurement positions on the two line segments LS, a minimum value of the Cr concentrations included within a range of $[Cr]_{ave}\pm3\sigma_{Cr}$ is defined as $[Cr^*]_{min}$, an average value of all of the Mo concentrations determined at all of the measurement positions on the two line segments LS is defined as $[Mo]_{ave}$, a sample standard deviation of all of the Mo concentrations determined at all of the measurement positions on the two line segments LS is defined as $\sigma_{Mo}$, among all of the Mo concentrations determined at all of the measurement positions on the two line segments LS, an average value of the Mo concentrations included within a range of $[Mo]_{ave}\pm3\sigma_{Mo}$ is defined as $[Mo^*]_{ave}$, among all of the Mo concentrations determined at all of the measurement positions on the two line segments LS, a maximum value of the Mo concentrations included within a range of $[Mo]_{ave}\pm3\sigma_{Mo}$ is defined as $[Mo^*]_{max}$, and among all of the Mo concentrations determined at all of the measurement positions on the two line segments LS, a minimum value of the Mo concentrations included within a range of $[Mo]_{ave}\pm3\sigma_{Mo}$ is defined as $[Mo^*]_{min}$, a degree of Cr segregation ΔCr defined by Formula (1), and a degree of Mo segregation ΔMo defined by Formula (2) satisfy Formula (3):

$$\Delta Cr=([Cr^*]_{max}-[Cr^*]_{min})/[Cr^*]_{ave} \quad (1)$$

$$\Delta Mo=([Mo^*]_{max}-[Mo^*]_{min})/[Mo^*]_{ave} \quad (2)$$

$$\Delta Cr+\Delta Mo\leq0.59 \quad (3).$$

2. The martensitic stainless steel material according to claim 1, wherein the chemical composition contains one or more elements selected from the group consisting of:

B: 0.0001 to 0.0050%,
Ca: 0.0001 to 0.0050%,
Mg: 0.0001 to 0.0050%,
rare earth metal (REM): 0.0001 to 0.0050%,
Nb: 0.01 to 0.15%, and
W: 0.01 to 0.20%.

* * * * *